US009037061B2

(12) United States Patent
Miki et al.

(10) Patent No.: US 9,037,061 B2
(45) Date of Patent: May 19, 2015

(54) FIXING APPARATUS

(71) Applicant: CANON KABUSHIKI KAISHA, Tokyo (JP)

(72) Inventors: Tsutomu Miki, Komae (JP); Kazuhisa Kemmochi, Suntou-gun (JP); Takahiro Hosokawa, Kawasaki (JP); Keisuke Abe, Yokohama (JP); Hikaru Osada, Kamakura (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/152,387

(22) Filed: Jan. 10, 2014

(65) Prior Publication Data

US 2014/0199101 A1 Jul. 17, 2014

(30) Foreign Application Priority Data

Jan. 11, 2013 (JP) ..... 2013-003235

(51) Int. Cl.
*G03G 15/20* (2006.01)

(52) U.S. Cl.
CPC .... *G03G 15/2053* (2013.01); *G03G 2215/2035* (2013.01)

(58) Field of Classification Search
CPC ..... G03G 15/2053; G03G 15/2064; G03G 2215/2035; G03G 2215/2038
USPC ..... 399/328, 329
See application file for complete search history.

(56) References Cited

U.S. PATENT DOCUMENTS

| | | | | |
|---|---|---|---|---|
| 7,206,541 | B2 | 4/2007 | Fukita et al. | |
| 7,224,922 | B2 | 5/2007 | Kemmochi | |
| 7,630,677 | B2 | 12/2009 | Osada et al. | |
| 7,778,582 | B2 | 8/2010 | Miki et al. | |
| 8,351,837 | B2 | 1/2013 | Kitano et al. | |
| 8,364,067 | B2 | 1/2013 | Miki et al. | |
| 8,483,603 | B2 | 7/2013 | Nihonyanagi et al. | |
| 2008/0124146 | A1* | 5/2008 | Bae et al. | 399/329 |
| 2008/0205948 | A1* | 8/2008 | Baba et al. | 399/329 |
| 2008/0253814 | A1* | 10/2008 | Suzuki et al. | 399/320 |
| 2011/0103808 | A1 | 5/2011 | Abe et al. | |
| 2011/0103809 | A1 | 5/2011 | Kuwata et al. | |
| 2011/0318036 | A1 | 12/2011 | Abe et al. | |
| 2013/0195532 | A1 | 8/2013 | Abe et al. | |
| 2014/0205330 | A1* | 7/2014 | Abe et al. | 399/307 |

FOREIGN PATENT DOCUMENTS

| | | | |
|---|---|---|---|
| JP | 10-321352 | A | 12/1998 |
| JP | 3807223 | B2 | 5/2006 |
| JP | 2009098357 | A | 5/2009 |

* cited by examiner

*Primary Examiner* — Gregory H Curran
(74) *Attorney, Agent, or Firm* — Fitzpatrick, Cella, Harper & Scinto

(57) ABSTRACT

A fixing apparatus includes a back-up member contacting an inner surface of a cylindrical belt; a roller having an elastic layer and contacting an outer surface of the belt, the roller being cooperative with the back-up member to form a fixing nip between the belt and the roller. A sheet carrying a toner image is nipped and fed through the fixing nip, during which the unfixed toner image is heat-fixed thereon by the fixing nip. The back-up member includes a portion contactable with the inner surface and having such a configuration that the belt forms a first curved surface convex toward the roller in an upstream region in the fixing nip with respect to a moving direction of the belt and that the belt forms a second curved surface convex toward the back-up member in a downstream region in the fixing nip with respect to the moving direction.

12 Claims, 15 Drawing Sheets

(a)

(b)

FIXING APPARATUS

FIELD OF THE INVENTION AND RELATED ART

The present invention relates to a fixing apparatus (device) which is mounted in an image forming apparatus such as an electrophotographic copying machine, an electrophotographic printer, etc.

A fixing apparatus (fixing device) which is to be mounted in an electrophotographic copying machine, an electrophotographic printer, and the like is desired to start up as quickly as possible, and also, to be as small in energy consumption as possible. Thus, a fixing device which employs a fixing belt has been put to practical use. A fixing device of this type has: a cylindrical fixation belt; a belt backing member, which is disposed on the inward side of the fixation belt loop; a pressure roller which forms a nip by being pressed against the belt backing member with the placement of the fixation belt between itself and belt backing member; etc. A sheet of recording medium which is bearing an unfixed toner image is conveyed through the nip while being heated in the nip. Thus, the toner image on the sheet P of recording medium becomes fixed to the sheet of recording medium.

There are various methods for heating a fixation belt. For example, there are a heating method which employs a heat generating flat member such as a ceramic heater, a heating method which employs a heating means based on electromagnetic induction, and the like, which are proposed in Japanese Laid-open Patent application No. 2009-98357, Japanese Patent No. 3,807,223, and Japanese Laid-open Patent Application No. H10-321352.

However, a fixing device, such as the one describe above, which employs a belt backing member to form a nip, is problematic in that it is likely to output a defective image, the defect of which is referred to as "cracking".

FIG. 16 is a magnified image of a "cracked" image, which was obtained with the use of a microscope. This "cracked" image was outputted by a fixing device, which employs a fixation belt, when the fixing device was used to fix a solid monochromatic image of cyan color to a sheet of recording paper (which hereafter may be referred to simply as sheet of paper). As is evident from FIG. 16, "cracking" is an image defect attributable to a phenomenon that as the toner particles, of which an unfixed image on a sheet of recording medium (paper) shift in position, the portions of the sheet, which were under the toner particles, become exposed. The primary cause of this image defect is the "wrinkles" which occur to the outward surface layer (parting layer) of a fixation belt. That is, the "wrinkles" are attributable to the displacement of the unfixed toner particles by the wrinkling of the outward surface layer of the fixation belt.

It is on the upstream side of the fixation nip, in terms of the recording medium conveyance direction in the fixation nip, that the toner particle displacement occurs. As for the reason for the toner particle displacement, when a given portion of a sheet of paper, on which an unfixed toner image is present, is in the upstream portion of the fixation nip, the toner particles on this portion of the sheet, will not have substantially melted. Therefore, they are weak in their adhesiveness to the sheet, and in the adhesiveness among them in this portion of the sheet. Therefore, they are likely to be shifted in position by the wrinkling of the outward surface layer of the fixation belt. In comparison, in the downstream side of the fixation nip in terms of the recording medium conveyance direction, the toner particles on the sheet will have substantially melted. Therefore, even if the outward surface layer of the fixation belt is wrinkled, it hardly occurs that the toner particles are displaced by the wrinkling of the outward surface layer of the fixation roller.

The "wrinkling" of the outward surface layer of a fixation belt occurs as the outward surface layer of the fixation belt is compressed in such a manner that the outward surface is concavely bent, or it becomes flat. As will be described later, as a given portion of a fixation belt, in terms of the moving direction of the fixation belt, is moved into a fixation nip, it is deformed by the combination of a belt backing member, and a pressure roller, against which the fixation belt is pressed by the belt backing member. Thus, in terms of its vertical cross-section, which is parallel to the moving direction of the fixation belt, the shape of the portion of the fixation belt in the fixation nip is determined by the shape of the belt backing member. Thus, as the outward surface layer of the fixation belt is changed in shape by the belt backing member as described above, wrinkles occur to the outward surface layer of the fixation belt.

Next, referring to FIGS. 17(*a*), 17(*b*) and 17(*c*), the mechanism of the wrinkling of the outward surface layer of the fixation belt is described. FIG. 17(*a*) is a schematic cross-sectional view of a section of the fixation belt, when the fixation belt is under no pressure. In FIG. 17(*a*), the portion outlined by a solid line (which corresponds to angle θ) is equivalent to the portion of the fixation belt, which is in the fixation nip when the fixation belt is under the pressure.

Referring to FIG. 17(*a*), referential codes Le and Li stand for the length of the outward and inward surfaces, respectively, of the portion of the surface layers of the fixation layer in the fixation nip. Referential codes Re and Ri stand for the radius of the outward surface of the outward surface layer of the fixation belt, and the inward surface of the fixation belt, respectively. Further, a referential code W stands for the thickness of the fixation belt (W=Re−Ri).

FIG. 17(*b*) is a schematic cross-sectional view of the portion of the fixation belt, which is shown in FIG. 17(*a*), when the portion is in the fixation nip, having thereby been flattened by being pressed upon an unshown belt backing member by an unshown pressure roller. In FIG. 17(*b*), referential codes Le' and Li' stand for the length of the outward surface of the portion outlined by the solid line, and the length of the inward surface of the portion outlined by the solid line, respectively. The length Le' has no direct relation to the wrinkling of the portion. It is the direct distance between points A and B in FIG. 17(*b*) that has direct relationship to the wrinkling.

FIG. 17(*c*) is a schematic cross-sectional view of the portion of the fixation belt, which is shown in FIG. 17(*b*), when the portion is in the fixation nip, having thereby been made to be concave in circular curvature, that is, deformed in such a manner that its is reversed in curvature from when it is in the state shown in FIG. 17(*a*). Also in FIG. 17(*c*), referential codes Le' and Li' stand for the length of the outward surface of the portion outlined by the solid line, and the length of the inward surface of the portion outlined by the solid line, respectively. The length Le' has no direct relation to the wrinkling of the portion. It is the direct distance between points A and B in FIG. 17(*c*) that has direct relation to the wrinkling.

First, a case in which a given portion of the fixation belt is flattened in the fixation nip as shown in FIG. 17(*b*) is described. As a portion of the fixation belt, the curvature of which is as shown in FIG. 17(*a*) is flattened as shown in FIG. 17(*b*), the inward surface of the fixation belt is slightly stretched, whereas the outward surface of the fixation belt is compressed by such an amount that makes its length roughly the same as the length of the stretched inward surface of the fixation belt. Generally speaking, a fixation belt is provided with a parting layer, which makes up the actual outward surface layer of the fixation belt, as will be described later. The parting layer cannot be easily compressed. Thus, as it is subjected to compressive force, it fails to be compressed. Consequently, it is wrinkled.

Here, the amount of difference between the pre-deformation length of the outward surface layer of the fixation belt and the post-deformation length of the outward surface layer of the fixation belt is referred to as the amount of fixation belt compression or fixation belt compression amount. The amount of fixation belt compression is expressible in the form of the following Equation (1).

$$\text{Amount of compression}=Le-Le' \quad (1)$$

In a case where a given portion of the fixation belt is flattened in the fixation nip, the length Le', that is, the length of the outward surface of the given portion after the deformation of the portion, is the same as the length Le', that is, the length of the inward surface of the given portion after the deformation. The dimension of the fixation nip in terms of the circumferential direction of the fixation belt, is very small relative to the circumference of the fixation belt. Thus, the angle θ is very small relative to 360° which corresponds to the circumference of the fixation belt. Therefore, it is reasonable to say that the length Li, which is the pre-deformation length of the inward surface of the given portion of the fixation belt is roughly the same as the length Li,' that is, the post-deformation length of the inward surface of the given portion of the fixation belt. Thus, Equation (1) which shows the amount of fixation belt compression may be rewritten as follows:

$$\text{Amount of Compression}=Le-Le'=Le-Li'\approx Le-Li \quad (2)$$

Further, the length Le, or the pre-deformation length of the outward surface layer of the fixation belt, can be obtained from the radius Re of the outward surface layer of the fixation belt and the angle θ of the sector of the cross-section of the fixation belt: Le=θ×Re. Similarly, the length Li, or the pre-deformation length of the inward surface of the given portion of the fixation belt, can be obtained from the radius Ri and the angle θ: Li=θ×Ri. Thus, Equation (2) can be rewritten as follows:

$$\begin{aligned}\text{Amount of Compression} &\propto \theta\times Re-\theta\times Ri \quad (3)\\ &=\theta\times(Re-Ri)\\ &=\theta W.\end{aligned}$$

A letter W stands for the thickness of the fixation belt as described above. As is evident from Equation (3), the amount of the compression of the fixation belt is proportional to the thickness W of the fixation belt. The greater the amount of the fixation belt compression, the greater the extent of the wrinkling of the outward surface layer of the fixation belt. Therefore, in a case where a given portion of the fixation belt is flattened in the fixation nip, the thicker the fixation belt, (as fixation belt is increased in thickness W), the greater the extent of the wrinkling of the outward surface layer of the fixation belt (surface layer of fixation belt wrinkles more), and therefore, the greater the extent of the image defect called "cracking".

Next, referring to FIG. 17(*c*), a case in which a given portion of the fixation belt is bent in the fixation nip in such a shape that it is made to concave toward the rotational axis of the fixation belt, that is, it is reversed in curvature from when it is in the state shown in FIG. 17(*a*), is described. As the given portion, the curvature of which was as shown in FIG. 17(*a*), is bent so that its curvature becomes as shown in FIG. 17(*c*), the inward surface of the fixation belt is stretched, but, the outward surface layer of the fixation belt is compressed. Thus, the outward surface layer of the fixation belt is made to wrinkle for the same reason as the one given above.

Also in this case, the "amount of compression" which is the difference between the pre-deformation length of the surface layer of a given portion of the fixation belt and the post-deformation length of the surface layer of the given portion of the fixation belt can be defined as in the case where the given portion is deformed as shown in FIG. 17(*b*). Referring to FIG. 17(*c*), the given portion of the fixation belt is deformed in such a shape that its curvature equals a circle, the radius of which is Rc, and the length of which is equivalent to the angle θ' of this circle, the "amount of compression" can be expressed in the form of the following Equation.

$$\begin{aligned}\text{Amount of Compression} &= Le-Le' \quad (4)\\ &=\theta\times Re-\theta'\times(Rc-W)\\ &=\theta' Re-\theta' Rc+\theta' W.\end{aligned}$$

Based on Equation (4), even in a case where a given portion of the fixation belt is deformed in such a manner that it is made to concave, the thicker the fixation belt, the greater the amount of compression of the given portion, and therefore, the greater the extent of the wrinkling of the outward surface layer of the fixation belt. From Equation (4), the smaller the given portion in the post-deformation radius Rc (greater in curvature), the greater the amount of compression, and therefore, the greater it will be in the extent of wrinkling. Therefore, the greater it will be in the extent of the image defect which is referred to as "cracking".

As will be evident from the foregoing, as a given portion of the fixation belt, the curvature of which is as shown in FIG. 17(*a*), is flattened or reversed in curvature as shown in FIGS. 17(*b*) and 17(*c*), respectively, the surface layer of this portion of the fixation belt is compressed, being therefore reduced in length. Therefore, it becomes positive in the amount of compression, which is calculable with the use of Equation (1). In comparison, in a case where the given portion of the fixation belt is stretched as it is deformed, it becomes positive in the amount of compression which is obtainable with the use of Equation (1), although this case is not illustrated here.

In other words, in a case where the amount of compression is positive, the fixation belt wrinkles, and the greater the amount of compression, the greater the extent of wrinkling. The greater the extent of wrinkling, the more serious, the image defect attributable to the wrinkling of the fixation belt. On the other hand, in a case where the amount of compression is negative, the fixation belt does not wrinkle. Therefore, the image defect attributable to the wrinkling of the fixation belt hardly occurs.

As will be evident from the foregoing description, the thicker the fixation belt, the greater it is in the difference between its internal (substrative layer) external diameters (surface layer), and therefore, the greater it is in the extent of wrinkling, or the vertical distance between the highest point of its peak and the bottom of its valley.

In recent years, a copying machine, a printer, and the like devices have come to be desired to be substantially increased in speed. Thus, in order to ensure that they remain satisfactory in image quality (fixation, in particular) in spite of increase in speed, they have been substantially increased in the thickness of the elastic layer of their fixation belt, as will be described later. Consequently, they have become substantially larger in the difference between the internal and external diameters of their fixation belt. Thus, it is reasonable to think that the issues related to the image defect, which is referred to as "cracking", will become one of the greater concerns. Further, it is also to be ensured that a sheet of recording medium easily separates from a fixation belt.

SUMMARY OF THE INVENTION

It is an object of the present invention to provide a fixing apparatus with which image defects attributable to the crease of the belt surface layer can be suppressed, and a separation of the recording material is easy.

According to an aspect of the present invention, there is provided a fixing apparatus comprising a cylindrical belt; a back-up member contacting an inner surface of said belt; a roller contacting an outer surface of said belt, said roller being provided with an elastic layer, said roller being cooperative with said back-up member to sandwich said belt and form a fixing nip between said belt and said roller; wherein a recording material carrying an unfixed toner image is nipped and fed through the fixing nip, during which the unfixed toner image on the recording material is heated and fixed thereon by the fixing nip, and wherein said back-up member includes a portion contactable with the inner surface of said belt, the portion having such a configuration that said belt forms a first curved surface which is substantially convex toward said roller in an upstream region in said fixing nip with respect to a moving direction of said belt and that said belt forms a second curved surface which is substantially convex toward said back-up member in a downstream region in said fixing nip with respect to the moving direction.

Further features of the present invention will become apparent from the following description of exemplary embodiments (with reference to the attached drawings).

DESCRIPTION OF THE PREFERRED EMBODIMENTS

Hereinafter, the present invention is described in detail with reference to the appended drawings.

[Embodiment 1]

(1) Example of Image Forming Apparatus

Figure 1:
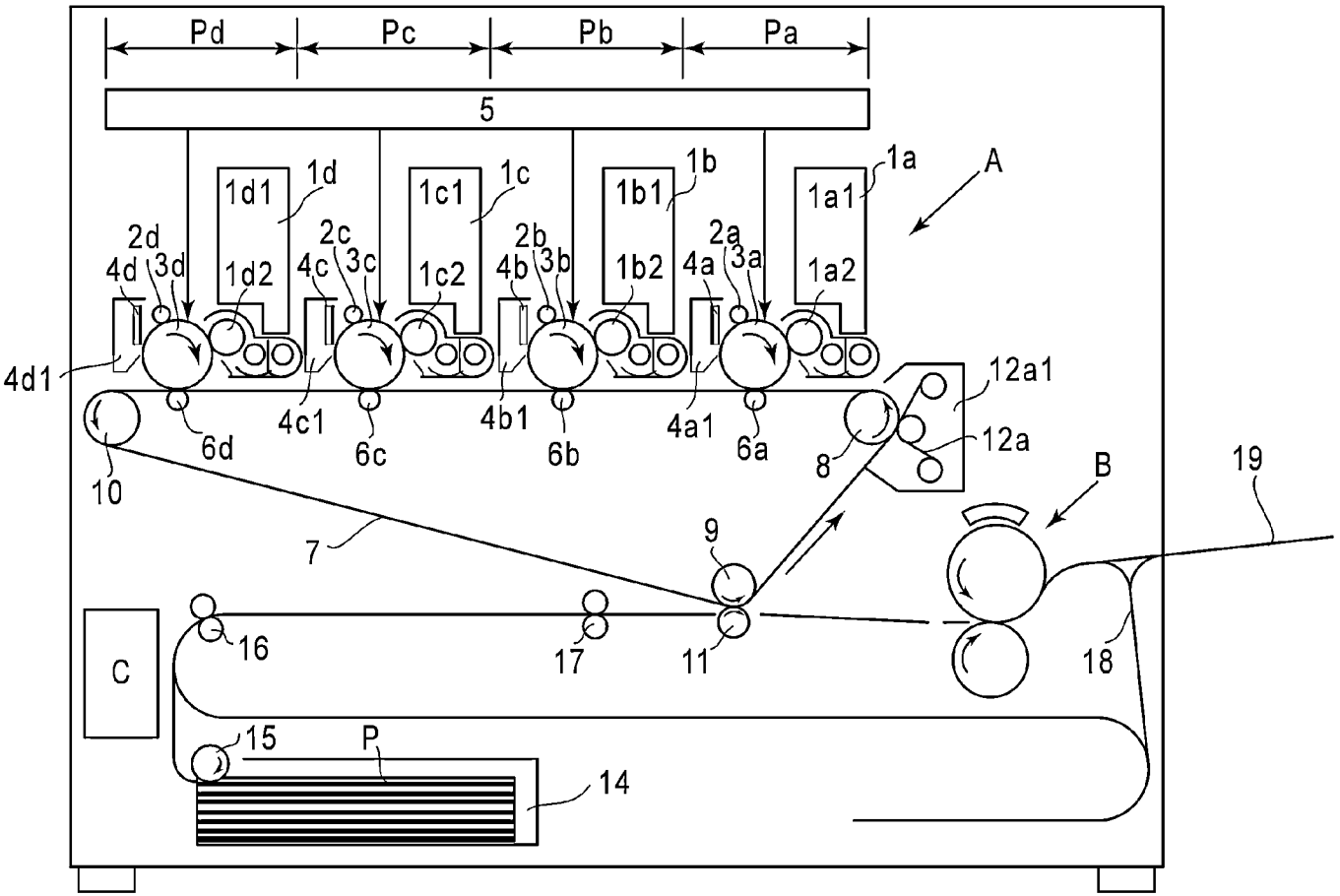
FIG. 1 is a schematic sectional view of a typical image forming apparatus to which the present invention is applicable, and shows the general structure of the apparatus.

FIG. 1 is a schematic sectional view of a typical image forming apparatus which employs a fixing device which is in accordance with the present invention. It shows the general structure of the apparatus. This image forming apparatus is a full-color laser beam printer which uses an electrophotographic image forming method. It is structured so that a sheet of recording medium is conveyed through the apparatus in such a manner that, in terms of the direction perpendicular to the recording medium conveyance direction of the apparatus, the center of the sheet of recording medium coincides with the center CL (FIG. 3(*a*)) of the recording medium passage of the apparatus.

The image forming apparatus in this embodiment has: an image formation section A which forms an unfixed toner image (image) on a sheet P of recording medium; a fixation section B which fixes the unfixed toner image on the sheet P of recording medium, to the sheet P; a control section C which controls the entirety of the apparatus; etc. The image formation section A has: four image formation stations Pa, Pb, Pc and Pd, which form cyan, magenta, yellow, and black monochromatic images, respectively; an intermediary transfer belt 7; etc. The control section C is made up of a CPU, and memories such as a ROM and a RAM. The memories store image formation sequences, various tables necessary for image formation, etc.

The image formation stations Pa, Pb, Pc and Pd have developing devices (developing means) 1*a*, 1*b*, 1*c* and 1*d*, which have toner containers 1*a*1, 1*b*1, 1*c*1 and 1*d*1 and development rollers 1*a*2, 1*b*2, 1*c*2 and 1*d*2, etc., which contain cyan, magenta, yellow, and black toners, respectively.

The image forming operation of the image forming apparatus in this embodiment is as follows. As the control section C receives a print command from an external apparatus (unshown) such as a host computer, it carries out an image formation control sequence. As the image formation sequence is started, the electrophotographic photosensitive members 3*a*, 3*b*, 3*c* and 3*d* (which are in the form of a drum, and therefore, will be referred to simply as photosensitive drum, hereafter), in the image formation stations Pa, Pb, Pc and Pd, respectively, are rotated in the direction indicated by arrow marks at a preset peripheral velocity (process speed). Further, the intermediary transfer belt 7, which is below the combination of the image formation stations Pa, Pb, Pc and Pd, and is stretched around the combination of three rollers, more specifically, a driver roller 8, a belt backing roller 9 which opposes a secondary transfer roller, and a tension roller 10, is rotated in the direction indicated by an arrow mark at a peripheral velocity which is equal to the peripheral velocity of the photosensitive drums 3*a*, 3*b*, 3*c* and 3*d*.

In the image formation station Pa, the peripheral surface of the photosensitive drum 3*a* is uniformly charged by a charge roller (charging means) 2*a* to preset polarity and potential level (charging process). Then, the uniformly charged portion of the peripheral surface of the photosensitive drum 3*a* is scanned by (exposed to) a beam of laser light outputted by a laser-based exposing device (exposing means) 5, whereby an electrostatic latent image, which is in accordance with the information of the image to be formed, is formed on the peripheral surface of the photosensitive drum 3*a* (exposing process). This latent image is developed into a visible image through a process of adhering toner of cyan color, which is in the toner container 1*a*1 of the developing device (developing means) 1*a*, to the latent image by the development roller 1*a*2. Consequently, a toner image of cyan color is formed on the peripheral surface of the photosensitive drum 3*a* (developing process).

Also in the image formation stations 1*b*, 1*c* and 1*d*, the charging, exposing, and developing processes which are similar to the above described ones carried out in the image formation station 1*a*, are carried out. Consequently, a toner image of magenta color, a toner image of yellow color, and a toner image of black color, are formed on the peripheral surface of the photosensitive drum 3*b*, peripheral surface of the photosensitive drum 3*c*, and peripheral surface of the photosensitive drum 3*d* in the image formation stations 1*b*, 1*c* and 1*d*, respectively.

The toner image of cyan color on the peripheral surface of the photosensitive drum 3*a* is conveyed, by the rotation of the photosensitive drum 3*a*, to the first transfer nip formed by the peripheral surface of the photosensitive drum 3*a* and the outward surface of the intermediary transfer belt 7, and then, is conveyed through the first transfer nip. While it is conveyed through the first transfer nip, a preset transfer bias is applied to a primary transfer roller 6*a*, which is positioned so that it opposes the photosensitive drum 3*a*, with the presence of the intermediary transfer belt 7 between itself and photosensitive drum 3*a*. Consequently, the toner image of cyan color on the peripheral surface of the photosensitive drum 3*a* is transferred onto the surface of the intermediary transfer belt 7 (primary transferring process).

Primary transferring processes (image formation processes) similar to the above described one are carried out in the image formation stations 1*b*, 1*c*, and 1*d*, one for one. That is, as a preset transfer bias is applied to the primary transfer roller 6*b*, the toner image of magenta color is transferred onto the intermediary transfer belt 7 in such a manner that it is layered upon the toner image of cyan color on the intermediary transfer belt 7. Further, a preset transfer bias is applied to the primary transfer roller 6*c*, the toner image of yellow color is transferred onto the intermediary transfer belt 7 in such a manner that it is layered upon the toner image of magenta color on the intermediary transfer belt 7. Moreover, as a preset transfer bias is applied to the primary transfer roller 6*d*, the toner image of black color is transferred onto the intermediary transfer belt 7 in such a manner that it is layered upon the toner image of yellow color on the intermediary transfer belt 7. Consequently, an unfixed full-color is formed of four monochromatic images, different in color, on the surface of the intermediary transfer belt 7.

Then, the unfixed full-color toner image on the intermediary transfer belt 7 is conveyed by the rotation of the intermediary transfer belt 7 to the secondary transfer nip formed by the surface of the intermediary transfer belt 7, and the peripheral surface of the secondary transfer roller 11. The secondary transfer roller 11 is positioned so that it sandwiches the intermediary transfer belt 7 between itself and the belt backing roller 8.

The transfer residual toner, that is, the toner remaining on the peripheral surface of the photosensitive drums 3*a*, 3*b*, 3*c* and 3*d* after the secondary transfer of the toner images, is removed by cleaning blades (cleaning means) 4*a*, 4*b*, 4*c* and 4*d*, which correspond in position to the photosensitive drums 3*a*, 3*b*, 3*c* and 3*d*, so that the photosensitive drums 3*a*, 3*b*, 3*c* and 3*d* can be used for the following image formation. After the removal of the transfer residual toner by the cleaning blades 4*a*, 4*b*, 4*c* and 4*d*, the transfer residual toner is stored in waste toner containers 4*a*1, 4*b*1, 4*c*1 and 4*d*1, respectively.

Meanwhile, sheets P of recording medium in a sheet feeder cassette 14 are fed one by one into the main assembly of the image forming apparatus. Then, each sheet P of recording medium is conveyed by a pair of sheet conveyance rollers 16 to a pair of registration rollers 17, which conveys the sheet P to the secondary transfer nip with a preset timing. Then, the sheet P is conveyed through the secondary transfer nip while remaining pinched by the surface of the intermediary transfer belt 7 and the peripheral surface of the secondary transfer roller 11. While the sheet P is conveyed through the secondary transfer nip, the unfixed full-color toner image on the surface of the intermediary transfer belt 7 is transferred onto the sheet P by a preset transfer bias applied to the secondary transfer roller 11 (secondary transfer process). Consequently, the unfixed full-color toner image made up of the four monochromatic toner images, different in color, is borne by the sheet P of recording medium.

After the transfer of the unfixed full-color toner image from the intermediary transfer belt 7, the surface of the intermediary transfer belt 7 is rid of the transfer residual toner, by the cleaning web (unwoven cloth) 12*a*, to be readied for the next image formation. The removed transfer residual toner is stored in a waste toner container 12*a*1.

The sheet P of recording medium, on which the unfixed full-color toner image is present is introduced into, and conveyed through, the fixation nip N (which will be described later) of the fixing section (which hereafter will be referred to as fixing device) B. While the sheet P is conveyed through the fixation nip N, the unfixed toner image is thermally fixed to the sheet P. Then, the sheet P is moved out of the fixation nip N, is conveyed to the delivery tray 19, and then, is discharged into the delivery tray 19.

There is present between the fixing device B and delivery tray 19, a recording medium turning mechanism 18, which turns the sheet P over so that the image bearing surface of the sheet P is switched in position with the surface of the sheet P which has no image.

Figure 2:
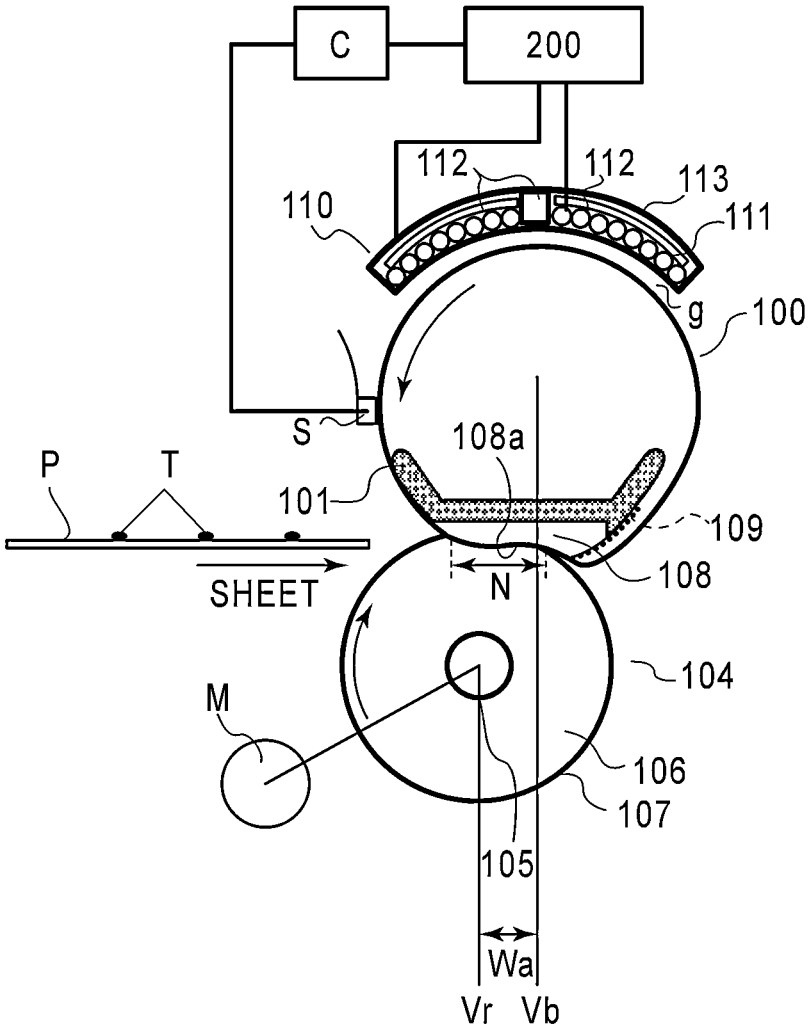
FIG. 2 is a schematic cross-sectional view of the fixing device in the first embodiment of the present invention, and shows the general structure of the device.
Figure 3:
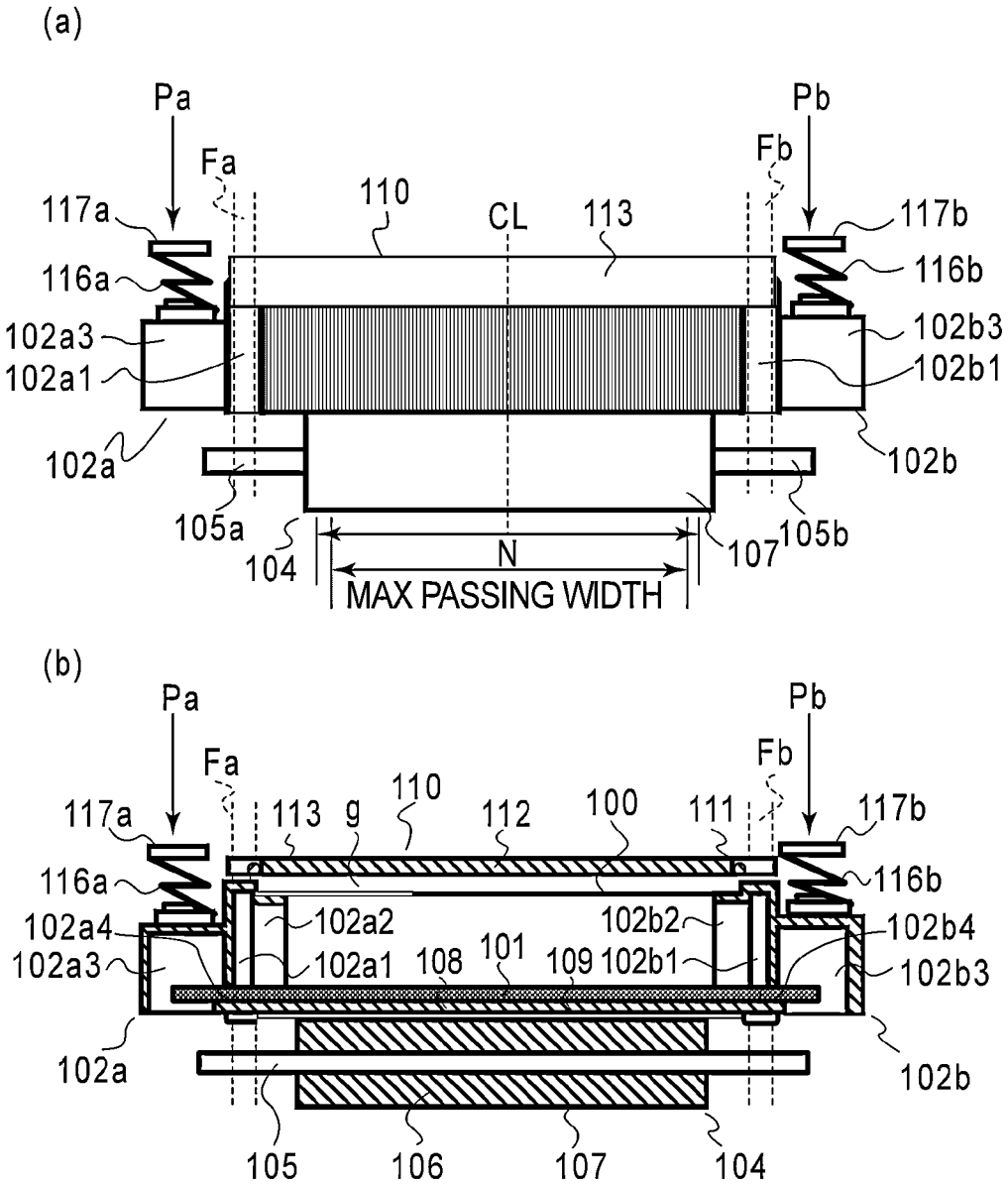
FIG. 3(*a*) is a schematic side view of the fixing device in the first embodiment, as seen from the upstream side of the device in terms of the recording conveyance direction, and shows the general structure of the device, and FIG. 3(*b*) is a schematic vertical sectional view of the fixing device shown in FIG. 3(*a*), and shows the general structure of the device.

(2) Fixing Apparatus (Fixing Device) B (2-1) General Structure of Fixing Apparatus B FIG. 2 is a schematic cross-sectional view of the fixing device B in this embodiment. FIG. 3(*a*) is a schematic side view of the fixing device B in this embodiment as seen from the upstream side of the device in terms of the recording medium conveyance direction of the device B. It shows the general structure of the device B. FIG. 3(*b*) is a schematic vertical sectional view of the fixing device B, shown in FIG. 3(*a*). It shows the general structure of the fixing device B. This fixing device B employs a fixation belt which is heated by electromagnetic induction.

The fixing device B in this embodiment has a fixation belt (heating belt) 100, a belt guide (heating belt guide) 101, and a pressure roller (pressure applying member) 104. It has also a belt backing member 108, a friction reducing sheet 109 which guides the fixation belt 100, a coil unit 110, etc. The fixation belt 1001, belt guide 101, pressure roller 104, and belt backing member 108, friction reducing sheet 109, and coil unit 110 are long and narrow, and their lengthwise direction is perpendicular to the sheet of paper on which FIG. 2 is present.

The fixation belt 100 is flexible and cylindrical. It is loosely fitted around a combination of the belt guide 101 and belt backing member 108. The belt guide 101 is formed of heat resistant resin, such as LCP (Liquid Crystal Polymer). It is roughly in the form of a trough, and is positioned so that its open side faces toward the rotational axis of the fixation belt 100. The belt backing member 108 is attached to the bottom surface of the belt guide 101. The fixation belt 100 in this embodiment is 30 mm in external diameter, and its dimension in terms of the direction parallel to the lengthwise direction of the fixing device 100, is greater than the length of a largest sheet of recording medium, which can be conveyed through the fixing device B (FIG. 3(*a*)).

Referring to FIGS. 3(*a*) and 3(*b*), the fixing device B is provided with a flange 102*a*, which is at one of the lengthwise ends of the fixation belt 100 (left side of FIGS. 3(*a*) and 3(*b*)). The flange 102*a* has a base portion 102*a*1, the external diameter of which is greater than the external diameter of the fixation belt 100. The base portion 101*a*1 has: a belt guide 102*a*2, which protrudes inward of the fixation belt loop (loop which fixation belt 100 forms); and a pressure bearing portion 102*a*3 which protrudes from the base portion 101*a*1, in the opposite direction from the belt guide 102*a*2. The belt guide 102*a*2 is roughly semi-cylindrical, and its radius is less than the internal radius of the fixation belt 100. It guides the fixation belt 100 to prevent the fixation belt 100 from deviating in the lengthwise direction of the fixing device B, as the belt 100 is rotated.

Further, the fixing device B is provided with a flange 102*b*, which is at the other lengthwise end (right side of FIGS. 3(*a*) and 3(*b*)) of the fixation belt 100 from where the flange 102*a* is present. The flange 102*b* has a base portion 102*b*1, the external diameter of which is greater than the external diameter of the fixation belt 100. The base portion 102*b*1 has: a belt guide 102*b*2, which protrudes inward of the fixation belt loop; and a pressure bearing portion 102*b*3 which protrudes from the base portion 102*b*1, in the opposite direction from the belt guide 102*b*2. The belt guide 102*b*2 is roughly semi-cylindrical, and its radius is less than the internal radius of the fixation belt 100. It guides the fixation belt 100 to prevent the fixation belt 100 from deviating in the lengthwise direction of the fixing device B, as the belt 100 is rotated.

The base portions 102*a*1 and 102*b*1 are provided with recesses 102*a*4 and 102*b*4 (FIG. 2(*b*)), which face the pressure roller 104 and extend in the lengthwise direction of the fixation belt 100. The belt guide 101 and belt backing member are fitted in these recesses 102*a*4 and 102*b*4, being thereby supported by their lengthwise ends, by the base portions 102*a*1 and 102*b*1.

The base portions 102*a*1 and 102*b*1 of the flanges 102*a* and 102*b*, which are positioned at the lengthwise ends of the fixation belt 100, one for one, are supported by the lateral plates Fa and Fb of the frame (unshown) of the fixing device B, respectively, in such a manner that they can be vertically moved.

The pressure roller 104 has: a metallic core 105; a rubber layer (elastic layer) 106, which covers the entirety of the peripheral surface of the metallic core 105, except for the lengthwise end portions 105*a* and 105*b* of the metallic core 105; a parting layer 107 which covers the peripheral surface of the rubber layer 106; etc. In this embodiment, the material for the metallic core is SUS (steel use stainless). The material for the rubber layer 106 is silicone rubber or the like. The parting layer 107 is formed of tetrafluoroethylene-perfluoroalkyl vinyl ether copolymer (PFA). The diameter of the pressure roller 104 in this embodiment is 24 mm.

In terms of the direction parallel to the recording medium conveyance direction, the above described pressure roller 104 is disposed so that a vertical line Vr which coincides with the rotational axis of the pressure roller 104 and is perpendicular to the generatrix of the pressure roller 104, is on the upstream side of the vertical line Vb which coincides with the rotational axis of the fixation belt 100 and is perpendicular to the generatrix of the fixation belt 100, being separated by a preset width Wa (FIG. 2). This pressure roller 104, and the belt backing member 108 which is on the inward side of the fixation belt loop, sandwich the fixation belt 100. The pressure roller 104 is rotatably supported by the lateral plates Fa and Fb, by the lengthwise end portions (shaft portions) 105*a* and 105*b*, with the placement of a pair of bearings (unshown) between the lengthwise end portions 105*a* and 105*b* and lateral plates Fa and Fb, respectively.

The belt backing member 108, which is not rotational, is a member for pressing the fixation belt 100 upon the pressure roller 104 to form the fixation nip N. The belt backing member 108 has a fixation belt pressing surface 108*a*, which is its downwardly facing surface and faces the pressure roller 104. The fixation belt pressing surface 108*a* is pressed on the inward surface of the fixation belt 100, forming thereby the fixation nip N. The shape of the fixation belt pressing surface 108*a* will be described later in detail. In this embodiment, the material for the belt backing member 108 is heat resistant resin such as LCP (liquid Crystal Polymer). It may be a ceramic or metallic substance.

Each of the pressure bearing portions 102*a*3 and 102*b*3 of the above described flanges 102*a* and 102*b* is under 300 N of pressure generated by each of a pair of coil springs 116*a* and 116*b*, in the directions indicated by arrow marks Pa and Pb, which are perpendicular to the pressure application referential surfaces 117*a* and 117*b*. Thus, the flanges 102*a* and 102*b* are kept pressed toward the pressure roller 104 by the resiliency of the coil springs 116*a* and 116*b*, causing the fixation belt pressing surface 108*a* of the belt backing member 103 to press on the inward surface of the fixation belt 100. Thus, the outward surface of the fixation belt 100 is pressed upon the peripheral surface of the pressure roller 104.

As the outward surface of the fixation belt 100 is pressed upon the peripheral surface of the pressure roller 104, the rubber layer 106 of the pressure roller 104 is compressed, being thereby elastically deformed. Consequently, the fixation nip N, which has a preset dimension (width) in terms of the rotational direction of the fixation belt 7, is formed between the outward surface of the fixation belt 100 and the peripheral surface of the pressure roller 104. In this embodiment, the width (in terms of rotational direction of fixation belt 100) of the fixation nip N is 8.4 mm.

The fixing device B in this embodiment is provided with the friction reducing sheet 109, which is placed between the fixation belt 100 and the belt backing member 108 to minimize the friction between the inward surface of the fixation belt 100 and the fixation belt pressing surface 108*a* of the belt backing member 108, in order to enable the fixation belt 100 to smoothly slide on the fixation belt pressing surface 108*a* of the belt backing member 108. This friction reducing sheet 109 is large enough to cover the entirety of the fixation belt pressing surface 108*a* in terms of the widthwise direction of the belt backing member 108. It is attached to the belt backing member 108 with the use of adhesive or the like to cover the entirety of the fixation belt pressing surface 108*a*. The material for the friction reducing sheet 109 is polyimide.

Figure 4:
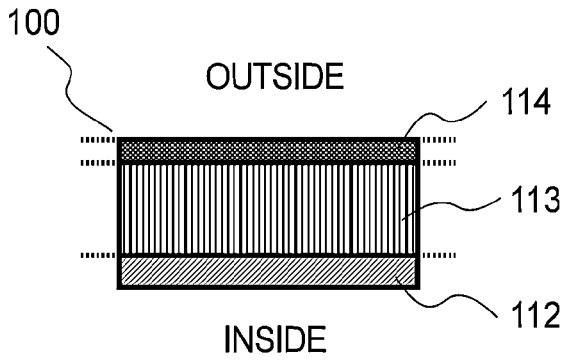
FIG. 4 is a schematic sectional view of the fixation belt of the fixing device in the first embodiment, and shows the laminar structure of the belt.

Next, referring to FIG. 4, the laminar structure of the fixation belt 100 is described. The fixation belt 100 has: a hollow, cylindrical, and metallic substrative layer, which generates heat by electromagnetic induction; an elastic layer 113 formed on the peripheral surface of the sustrative layer 112, with the placement of a primary layer (unshown) between the peripheral surface of the substrative layer and the elastic layer 113*p*; and a parting layer 114 formed of fluorinated resin, on the outward surface of the elastic layer 113.

As the material for the substrative layer 112, nonmagnetic stainless steel, aluminum, or the like, may be used in place of magnetic metal such as iron, nickel, and stainless steel. In this embodiment, nickel is used as the material for the substrative layer 112. Regarding the thickness of the substrative layer 112, from the standpoint of temperature control and thermal response, it is desired to be as small as possible in thermal capacity, and therefore, as thin and possible. However, from the standpoint of durability, it is desired as thick as possible. Thus, the thickness of the substrative layer 112 in this embodiment was made to be roughly one to several hundred times the depth of penetration of electromagnetic wave, the frequency of which is in a range of 20 kHz-several hundreds kHz, that is, the range suitable for electromagnetic induction. In this embodiment, the thickness of the substrative layer 112 was 75 μm.

As the material for the elastic layer 113, a substance such as silicone rubber, fluorinated rubber, and fluoro-silicone rubber, that is excellent in heat resistance and thermal conductivity is used. In this embodiment, solid silicone rubber which is 0.50-1.60 W/m·K in thermal conductivity was used. The elastic layer 113 in this embodiment was 280 μm in thickness.

As the material for the parting layer 114 in this embodiment, PFA was used. However, instead of PFA, fluorinated resin such as polytetrafluoroethylene (PTFE), tetrafluoroethylene-hexafluoropropylene copolymer (FEP), or the like, may be used as the material for the parting layer 114. Further, the parting layer 114 may be a layer of GLS latex paint coated on the outward surface of the elastic layer 113. That is, the parting layer 114 may be a piece of tube stretched to cover the entirety of the outward surface of the elastic layer 113, or a layer of the abovementioned paint coated on the outward surface of the elastic layer 113. A piece of tube, which is excellent in durability was used. The thickness of the parting layer 114 was 30 μm.

In order to minimize the friction between the fixation belt 100 and friction reducing sheet 109, the inward surface of the fixation belt 100 is coated with a slippery substance. In this embodiment, the material of this friction reducing layer on the inward surface of the fixation belt 100 was polyimide, and the thickness of this layer was 30 μm.

A coil unit 110 is disposed on the opposite side of the fixation belt 100 from the pressure roller 104. It has: an excitation coil 111 (magnetic field generating means) as a heating energy source; a magnetic core 112; a holder 113; etc.

The holder 113 is in the form of a long and narrow box, the lengthwise direction of which is parallel to the lengthwise direction of the fixation belt 100. It is disposed in parallel to the fixation belt 100, with its lengthwise end portions held by the aforementioned lateral plates Fa and Fb, one for one (FIG. 3(*a*)). More concretely, the holder 113 is in the form of a shallow trough, which is semi-circular in cross-section, and the curvature of which matches the curvature of the outward surface of the fixation belt 100. It is disposed so that its concave side opposes the outward surface of the fixation belt 100 with the presence of a preset gap g between itself and fixation belt 100.

The excitation coil 111 is shaped so that its curvature matches the curvature of the fixation belt 100. It is in the holder 113, being positioned so that a preset distance is maintained between itself and the outward surface of the fixation belt 100. As the wire for the excitation coil 111, litz wire made by bundling several tens to roughly 200 strands of electrically conductive fine wire, which are 0.1-0.3 mm in diameter, was used. The fine wire is coated with electrically insulating substance. That is, the excitation coil 111 was made by winding the litz wire around the magnetic core 112 several to several tens of times. The excitation coil 111 is in connection to an excitation circuit 200 so that alternating electric current can be supplied to the excitation coil 111 from the excitation circuit 200.

The magnetic core 112 is made of a ferromagnetic substance. It is structured so that it embraces the excitation coil, with its center portion fitting in the center of the excitation coil 111. The magnetic core 111 plays the role of efficiently guiding the alternating magnetic flux generated by the excitation coil 111, to the substrative layer 112 of the fixation belt 100. That is, the magnetic core 112 improves in efficiency the magnetic circuit made up of the excitation coil 111 and the substrative layer 112 of the fixation belt 100.

The length of the excitation coil 111, and the length of the magnetic core 112, are greater than the length of the long edge of a largest sheet of paper conveyable through the fixing device B.

(2-2) Driving and Temperature Control of Fixing Device B

The control section C rotationally drives a motor (FIG. 2) M as a driving force source, in response to a print command. The rotation of the output shaft of the motor M is transmitted to a driving gear (unshown) attached to one of the lengthwise ends of the metallic core 105, through a gear train (unshown). Thus, the pressure roller 104 rotates at a preset peripheral velocity in the direction indicated by an arrow mark. In this embodiment, the pressure roller 104 is rotated at a peripheral velocity of 321 mm/sec.

The rotation of this pressure roller 104 is transferred, as belt driving force, to the fixation belt 100 by the friction between the peripheral surface of the pressure roller 104 and the outward surface of the fixation belt 100, in the fixation nip N. Thus, the fixation belt 100 is rotated by the rotation of the pressure roller 104, remaining in contact with the friction reducing sheet 109 by its inward surface. It is possible that while the fixation belt 100 is rotated, it will deviate in its lengthwise direction. However, if the fixation belt 100 deviates in its lengthwise direction, one of its edges comes into contact with the base portion 102*a* or 102*b* of the corresponding flange 102*a* or 102*b*, respectively. Therefore, the fixation belt 100 is prevented from deviating in its lengthwise direction.

Further, the control section C starts up the excitation circuit 200 in response to the print command. The excitation circuit 200 causes alternating electric current to flow through the excitation coil 111 of the coil unit 110. Thus, the excitation coil 111 generates an alternating magnetic flux. This alternating magnetic flux is guided by the magnetic core 112 to the fixation belt 100, generating thereby eddy current in the outward surface layer of the fixation belt 100. Thus, Joule's heat is generated in the fixation belt 100 due to the presence of the intrinsic electrical resistance of the substrative layer 112.

The temperature of the fixation belt 100 is detected by a temperature detecting member S, such as a thermistor, which is placed in the adjacencies of, or in contact with, the outward surface of the fixation belt 100. Then, the signals outputted by the temperature detecting member S are taken in by the control section C. Then, the control section C controls the excitation circuit 200 in response to the output signals from the temperature detecting member S, so that the temperature of the fixation belt 100 remains at a preset level (fixation temperature: target temperature).

While the motor M is rotationally driven, and the alternating electric current is flowed through the excitation coil 111, a sheet P of recording medium, on which an unfixed toner image is present, is introduced into the fixation nip N, in such an attitude that the image bearing surface of the sheet P faces the fixation belt 100. Then, the sheet P is conveyed through the fixation nip N, remaining sandwiched between the outward surface of the fixation belt 100 and the peripheral surface of the pressure roller 104. While the sheet P is conveyed through the fixation nip N, the unfixed toner image on the sheet P is heated by the heat of the fixation belt 100, while being subjected to the internal pressure of the fixation nip N. Thus, the unfixed toner image on the sheet P becomes fixed to the sheet P. Then the sheet P is conveyed out of the fixation nip N. Then, the sheet P is discharged from the fixing device B in such a manner that the toner image bearing surface of the sheet P separates from the outward surface of the fixation belt 100.

(3) Shape of Fixation Belt Pressing Surface 108*a* of Belt Backing Member 108

Figure 5:
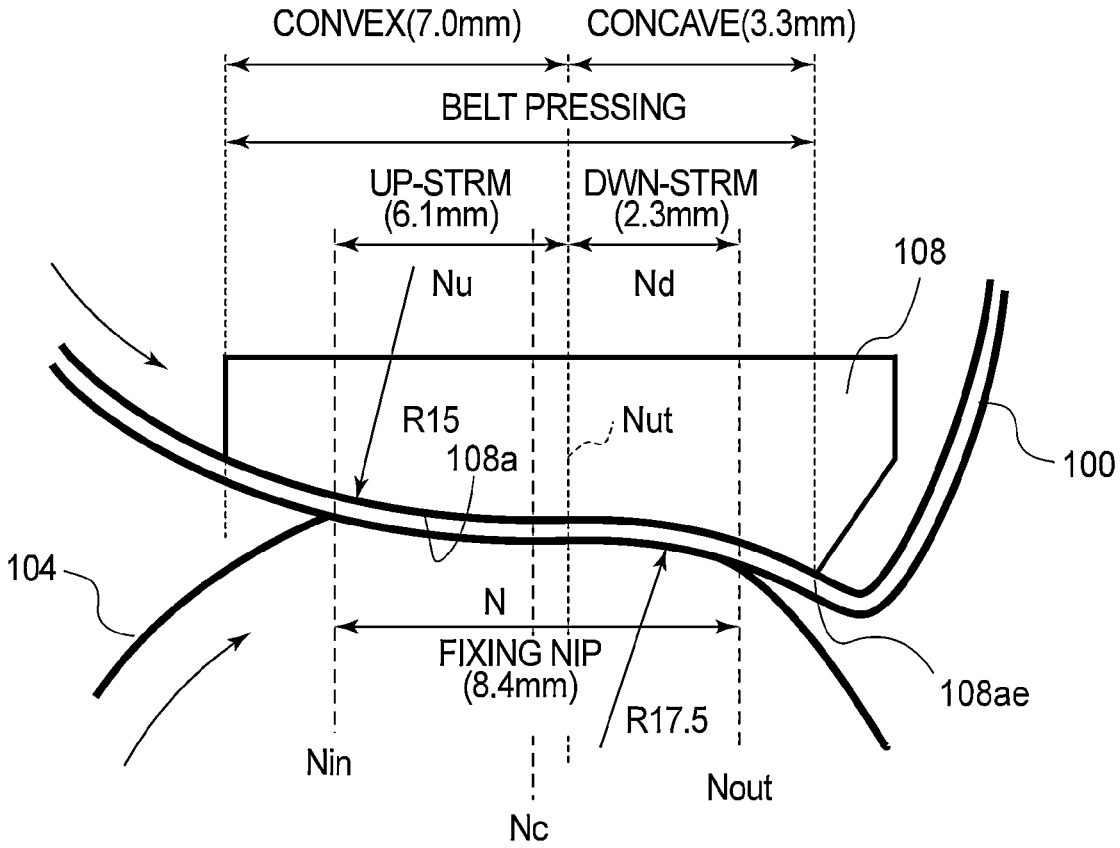
FIG. 5 is a schematic cross-sectional view of the fixation nip, and its adjacencies, of the fixing device in the first embodiment, and shows the general structure of the fixation nip and its adjacencies.

FIG. 5 is a schematic cross-sectional view of the fixation nip N, and its adjacencies, of the fixing device B in this embodiment. It shows the structure of the fixation nip N and its adjacencies. It should be noted here that in order to make it easier to recognize the shape of the fixation belt pressing surface 108*a* of the belt backing member 108, the belt guide 101 and friction reducing sheet 109 are not illustrated in FIG. 5.

In this embodiment, the shape of the fixation belt pressing surface 108*a* of the belt backing member 108, in terms of its cross-sectional view, is such that the portion of the fixation belt pressing surface 108*a*, which is in the upstream area of the fixation nip N, in terms of the recording medium conveyance direction, bulge in circular curvature (first curved surface) toward the pressure roller 104, whereas the portion of the fixation belt pressing surface 108*a*, which is the downstream area of the fixation nip N concaves in curvature (second curved surface).

More concretely, referring to FIG. 5, in this embodiment, the portion of the fixation belt pressing surface 108*a*, which bulges in circular curvature, was 7 mm in width, and the portion of the fixation belt pressing surface 108*a*, which concaves in curvature was 3.3 mm in width. Further, the portion of the fixation belt pressing surface 108*a*, which bulges in circular curvature toward the pressure roller 104 in the upstream area of the fixation nip N was 6.1 mm in width. Therefore, the rest of the fixation belt pressing surface 108*a*, which is in the fixation nip N and concaves in curvature, was 2.3 mm (8.4 mm (nip width)-upstream portion (6.1 mm)) in width. Here, "bulges in circular curvature" means to protrude in curvature toward the pressure roller 104, and "concaves in curvature" means to recess toward the opposite surface of the belt backing member 108 from the fixation belt pressing surface 108*a*.

That is, in terms of the cross-sectional view of the belt backing member, the portion of the fixation belt pressing surface 108*a* of the belt backing member 108, which is in the upstream area Nu of the fixation nip N relative to the center Nc of the fixation nip N in terms of the recording medium conveyance direction, bulges in circular curvature toward the pressure roller 104, whereas the portion of the fixation belt pressing surface 108*a* of the belt backing member 108, which is in the area between the downstream edge Nut of the upstream area Nu, and the downstream edge of the fixation nip N, in terms of the rotational direction of the fixation belt 100, concaves in curvature away from the pressure roller 104.

In the case of the fixing device B in this embodiment, the above described curvature in which the upstream portion of the fixation belt pressing surface 108*a* bulges toward the pressure roller is equivalent to the curvature of a circle which is 15 mm in radius (which hereafter may be referred to as R15). As described above, the external diameter of the fixation belt 100 is 30 mm (R15). Thus, the relationship between the radius R1 of the curvature in which the upstream portion of the fixation belt pressing surface 108*a* bulges, and the radius R2 is: R1=R2. Therefore, when a given portion of the fixation belt 100, is in the portion of the fixation nip N, which is between the entrance Nin of the fixation nip N to a point which is 6.1 mm downstream from the entrance Nin, the given portion of the fixation belt 100 is allowed to maintain its intrinsic curvature, and therefore, it smoothly moves, that is, without being stressed. Thus, in the above described area of the fixation nip N, that is, the area from the nip entrance Nin to the point which is 6.1 mm downstream from the entrance Nin, the above described amount of "compression" of the outward surface layer of the fixation belt 100 is zero.

In comparison, the curvature of the above-described concaved portion is equivalent to the curvature of a circle which is R17.5. Therefore, the amount of compression of the portion of the fixation belt 100, which is between the downstream edge Nut of the upstream portion area Nu in the fixation nip N, and the exit Nout of the fixation nip N, is greater than zero (amount of compression >0).

Figure 6:
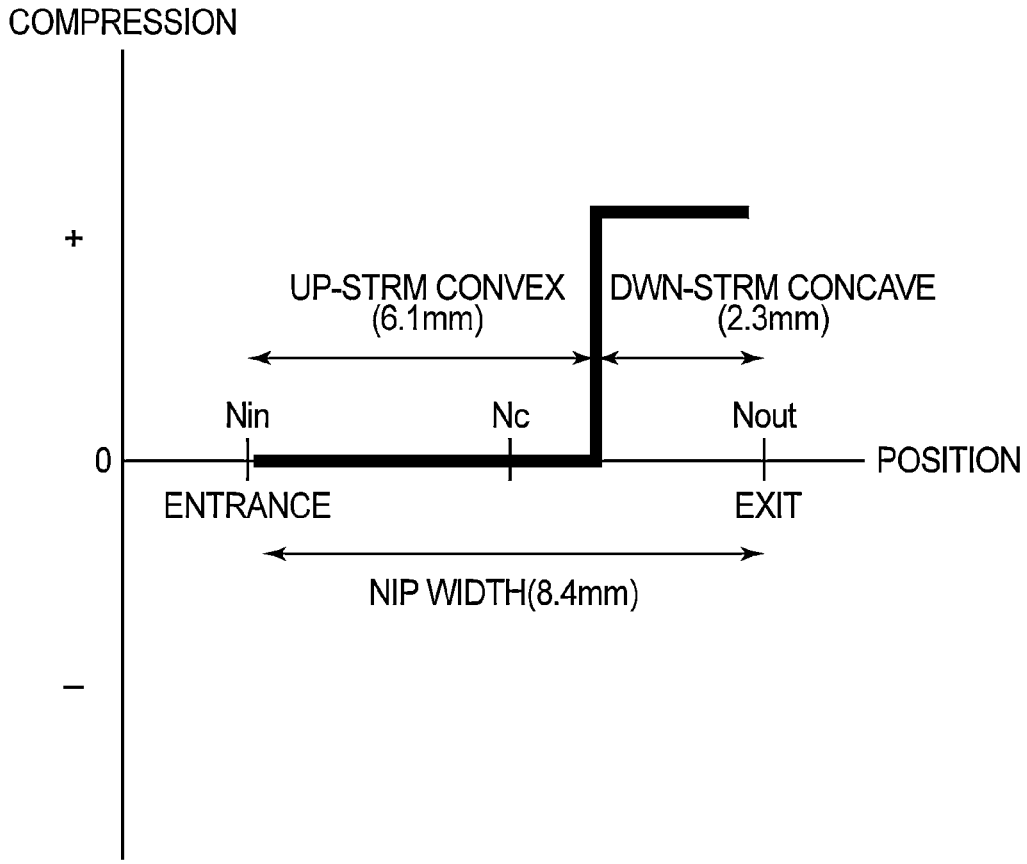
FIG. 6 is a schematic drawing for showing the amount of compression of the outward surface layer of the fixation belt of the fixing device in the first embodiment, in the fixation nip.

FIG. 6 shows the changes in the amount of compression of the outward surface layer of the fixation belt 100, which occur in the fixation nip N. As will be evident from FIG. 6, in the case of the fixing device B in this embodiment, which is structured as described above, the amount by which fixation belt 100 is compressed in the upstream area Nu of the fixation nip, relative to the center Nc of the fixation nip N, is no more than zero (amount of compression ≤0. Therefore, it is unlikely that this area of the fixation nip N causes image defects. The temperature of the toner, of which the unfixed toner is formed (toner on sheet P), exceeds the softening point (Tg) of toner while the toner is in the upstream area Nu in the fixation nip N relative to the center Nc, although it will be affected by the condition under which an image forming apparatus is used. Therefore, if the parting layer 114, which is the outward surface layer of the fixation belt 100 wrinkles in the upstream area Nu of the fixation nip N, it is likely for some of the toner particles on a sheet P of recording medium to be shifted in position. Therefore, it is desired that the portion of the fixation belt pressing surface 108*a* of the belt backing member 108, which bulges in circular curvature toward the pressure roller 104, extends downstream from the nip entrance Nin beyond the center Nc of the fixation nip N.

The amount by which the fixation belt 100 is compressed in the downstream area Nd of the fixation nip N, which is 2.3 mm in width is positive in value. However, in the downstream area Nd in the fixation nip N, the toner particles on the sheet P of recording medium will have melted further, becoming therefore better fixed to the sheet P, as described before. Therefore, even if the parting layer 114, that is, the outward surface layer of the fixation belt 100, wrinkles, it hardly occurs that the toner particles on the sheet P are shifted in position enough for the area of the surface of the sheet P, which is under the toner particles, to become exposed.

Shaping the fixation belt backing member 108 so that its portion in the upstream area Nu of the fixation nip N bulges in circular curvature toward the pressure roller 104, has the secondary effect, which is the increase in the internal pressure of the upstream area Nu in the fixation nip N. Making the portion of the fixation belt pressing surface 108*a*, which corresponds in position to the upstream area Nu of the fixation nip N, bulge in circular curvature toward pressure roller 104, increases the belt backing member 108 (fixation belt pressing surface 108*a*) in the depth of its intrusion into the pressure roller 104. It therefore increases the upstream area Nu of the fixation nip N in internal pressure, which in turns makes it easier for the toner to melt. Thus, the toner becomes more adherent to the sheet P of recording medium (paper), and also, toner particles increase in the force of mutual adhesion. Therefore, it becomes unlikely for the toner particles on the sheet P to be shifted in position. That is, this secondary effect makes it even more unlikely for the image forming apparatus to output a defective image, the defect of which is attributable to the problem that the toner particles on a sheet of recording medium are made to shift in position by the wrinkling of the fixation belt.

From the standpoint of merely preventing the problem that the wrinkling of the fixation belt of an electrophotographic image forming apparatus makes the apparatus output a defective image, the entire portion of the fixation belt pressing surface 108*a* of the belt backing member 108, in the fixation nip N, may be made to bulge in circular curvature toward the pressure roller 104, like in the upstream area Nu. However, such a structural arrangement makes it difficult for a sheet P of recording medium (paper) to separate from the outward surface of the fixation belt 100.

In this embodiment, therefore, the fixation belt pressing surface 108*a* is shaped so that its portion in the upstream area Nu of the fixation nip N, which is necessary to prevent the image forming apparatus from outputting a defective image, the defects of which is attributable to the wrinkling of the outward surface layer of the fixation belt 100, bulges toward the pressure roller 104 in the above described curvature, and its portion in the downstream area Nd in the fixation nip N concaves in the above described curvature to ensure a sheet of recording medium (paper) separates from the outward surface of the fixation belt 100.

In order to ensure that a sheet of recording medium (paper) separates from the outward surface of the fixation belt 100, the fixation belt pressing surface 108*a* of the belt backing member 108 (fixation nip N) has to be shaped so that when the sheet comes out of the fixation nip N, the downstream portion of the sheet is directed away from the fixation belt 100 (toward pressure roller 104), and the fixation belt 100 is guided away from the pressure roller 104.

Therefore, the inventors of the present invention built a fixing device structured so that the belt backing member 108 is displaced downward in terms of the belt movement direction (to position the rotational axis of the fixation belt 100 downstream relative to the rotational axis of the pressure roller 104 by a distance Wa in terms of the belt movement direction) to optimize the fixing device B in terms of the state of separation of a sheet of recording medium (paper) from the outward surface of the fixation belt 100. Then, the fixing device was used to study this structural arrangement. The results of the study confirmed that in the case of a fixing device such as the fixing device B in this embodiment structured as described above, providing a distance of 1 mm between the exit Nout of the fixation nip N and the downstream edge 108*ae* of the area of contact between the fixation belt pressing surface 108*a* and fixation belt 100 makes a sheet of recording medium (paper) naturally separate from the outward surface of the fixation belt 100.

Figure 7:
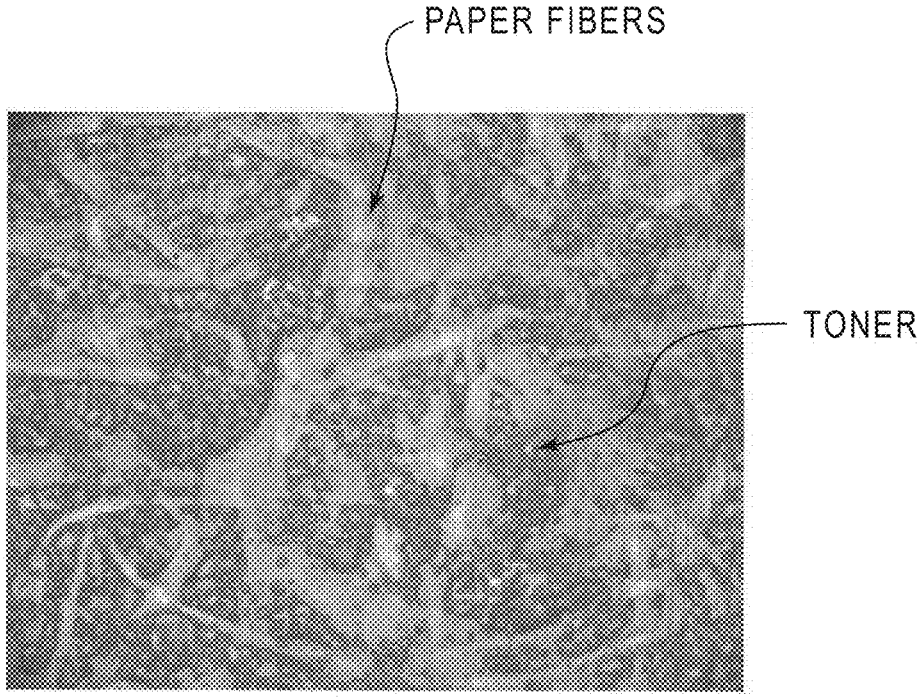
FIG. 7 is a magnified view of a part of a toner image fixed to a sheet of recording medium by the fixing device in the first embodiment, which was obtained with the use of a microscope.
Figure 16:
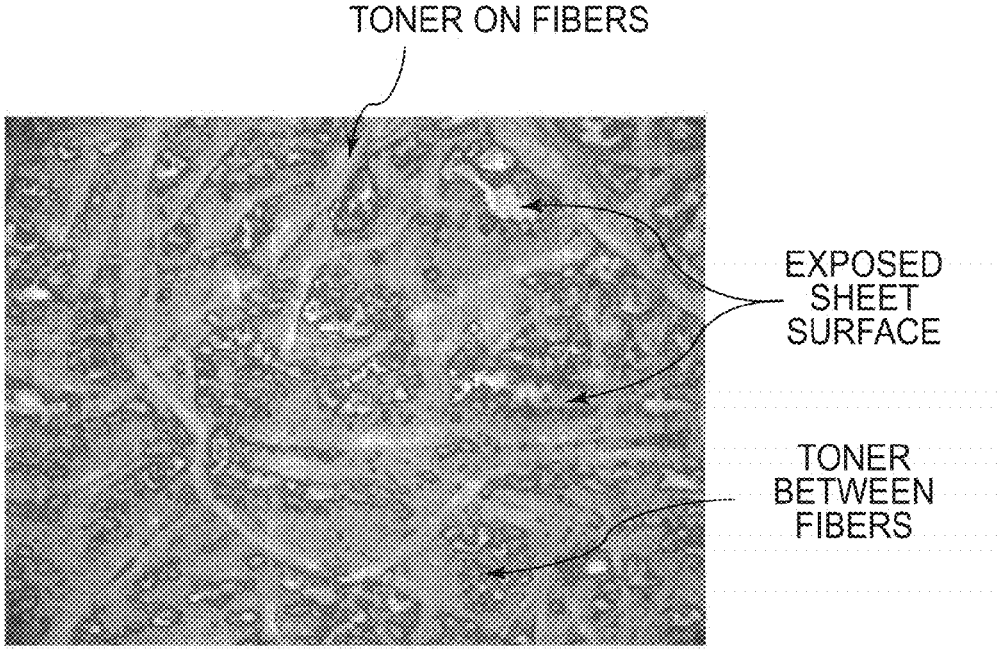
FIG. 16 is a magnified view of a part of a toner image fixed to a sheet of recording medium by a conventional fixing device, which was obtained with the use of a microscope.
Figure 17:
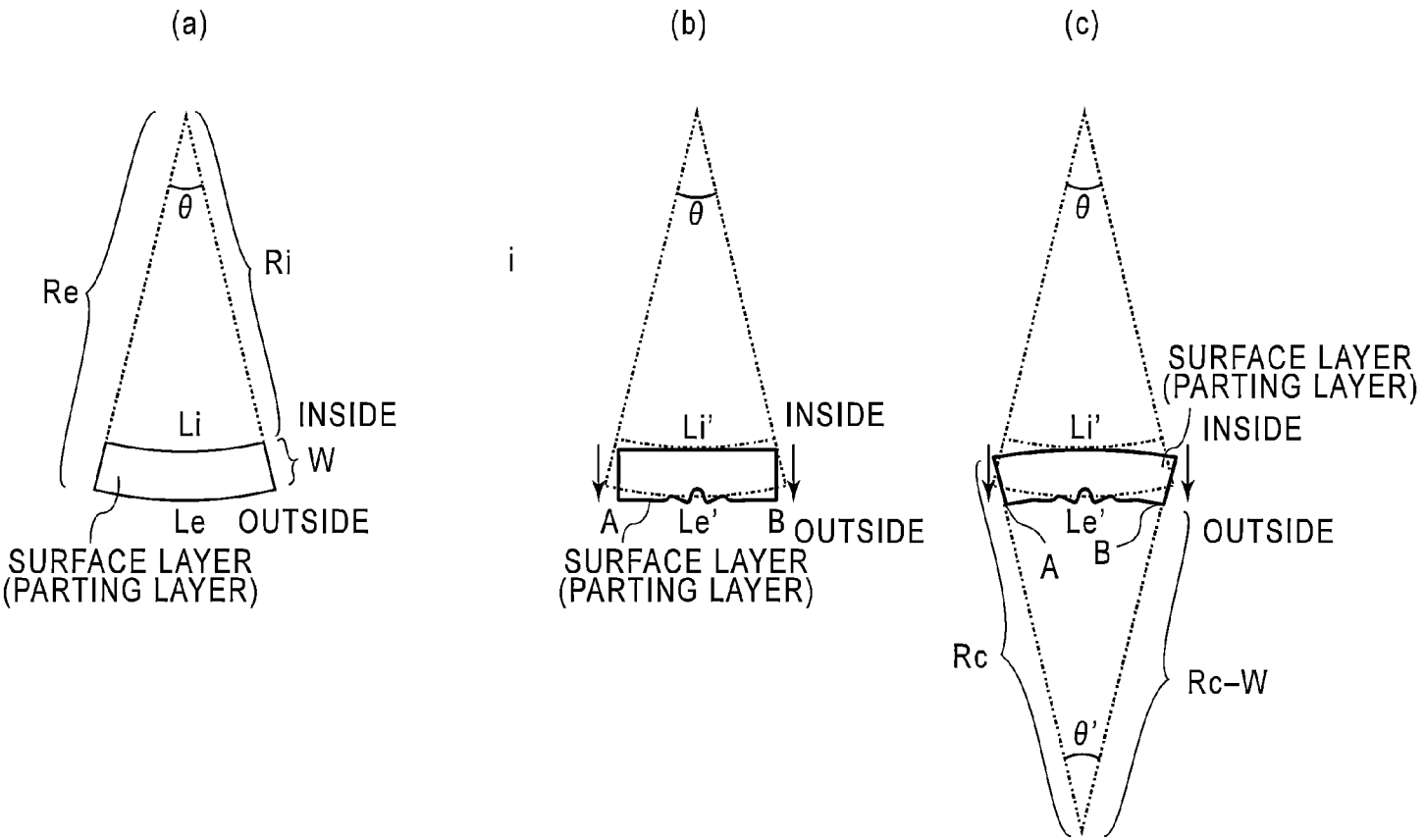
FIG. 17 is a schematic drawing for explaining the principle, based on which the surface layer of a fixation belt wrinkles.

FIG. 7 is an enlarged view, which was obtained with a microscope, of a part of a fixed solid monochromatic cyan image formed on a sheet of recording paper with the use of a full-color laser printer which employs the fixing device B in this embodiment. It is obvious from the comparison between FIGS. 7 and 16 that the image in FIG. 7 does not show any sign of the image defect called "cracking".

[Embodiment 2]

Next, another embodiment of the present invention is described. The fixing device B in this embodiment is also of the belt-based heating method. However, this fixing device B employs a ceramic heater (heat generating member) as a heat source. The fixing device B in this embodiment is virtually the same as the fixing device in the first embodiment, except that its heater 118 doubles as the belt backing member 108 in the first embodiment, and some of the structural components of this fixing device B are different in measurements or the like attributes.

(1) Fixing Device

Figure 8:
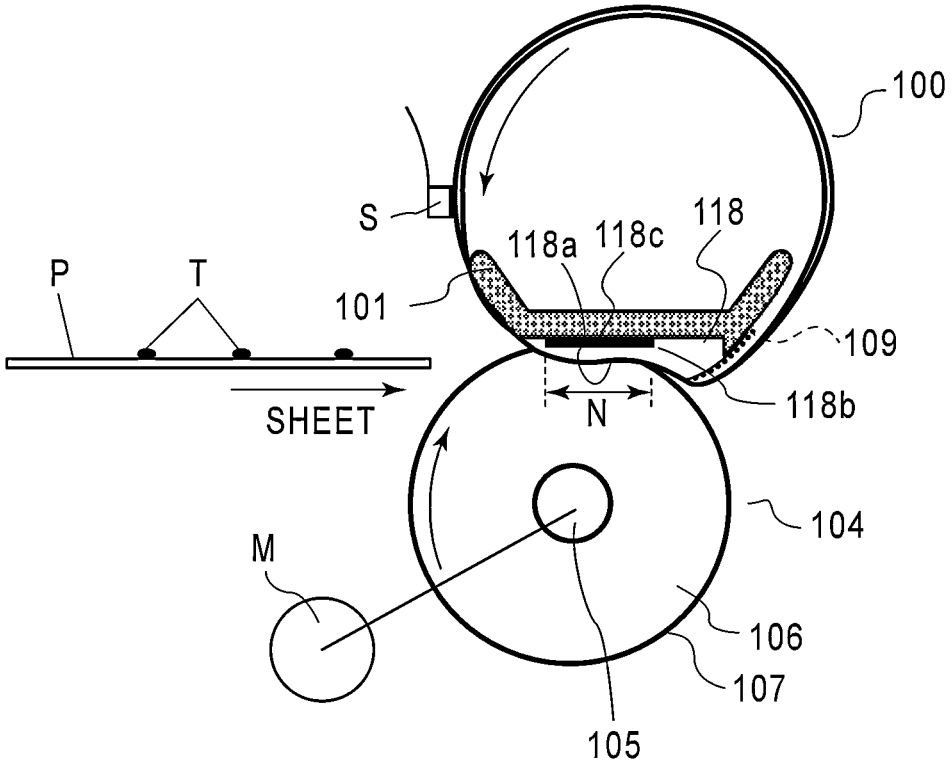
FIG. 8 is a schematic cross-sectional view of the fixing device in the second embodiment of the present invention, and shows the general structure of the device.
Figure 9:
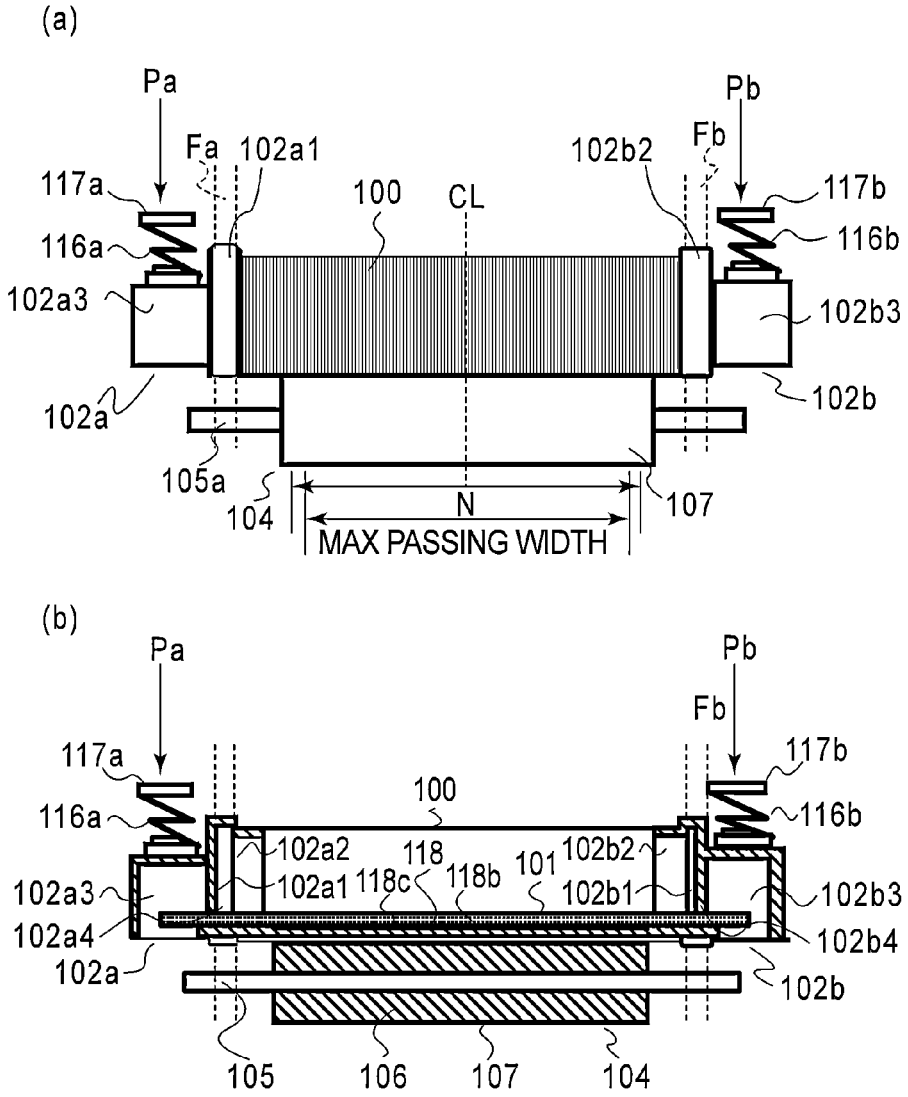
In FIG. 9, (*a*) is a schematic side view of the fixing device in the second embodiment, as seen from the upstream side of the device in terms of the recording conveyance direction, and shows the general structure of the device, and (*b*) is a schematic vertical sectional view of the fixing device shown in FIG. 9(*a*), and shows the general structure of the device.
Figure 10:
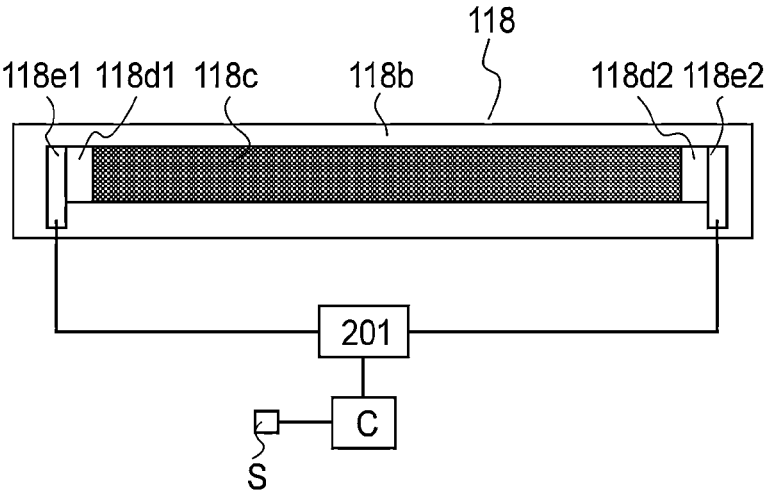
FIG. 10 is a rear view of the ceramic heater of the fixing device in the second embodiment, and shows the general structure of the ceramic heater.

FIG. 8 is a schematic cross-sectional view of the fixing device B in this embodiment. It shows the general structure of the device B. FIG. 9(*a*) is a schematic side view of the fixing device B in this embodiment, as seen from the upstream side of the device in terms of the recording conveyance direction, and shows the general structure of the device B, and FIG. 9(*b*) is a schematic vertical sectional view of the fixing device B shown in FIG. 9(*a*), and shows the general structure of the device B. FIG. 10 is a schematic view of the ceramic heater 118 in this embodiment, as seen from the center of the fixation belt loop, and shows the general structure of the heater 118.

(1-1) Overall Structure of Fixing Device B

Referring to FIG. 8, a referential code 100 stands for a fixation belt in this embodiment. The substrative layer 112 of this fixation belt 100 is 34 μm in thickness. Its material is SUS. The outward surface of the substrative layer 112 is covered with an elastic layer 113 formed of silicone rubber. In this embodiment, the thickness of this silicone rubber layer is 275 μm. Further, the outward surface of the elastic layer 113 is covered with a parting layer 114 formed of PFA, which is 30 μm in thickness. In this embodiment, the external diameter of the fixation belt 100 is 25 mm.

The heater 118 is attached to the bottom surface of the belt guide 110. It has a long and narrow substrate 118*b*, which is formed in a preset shape, of a metallic substance such as aluminum, iron, copper, or the like. The heater 118 has also an unshown insulating layer formed by hardening the heat resistant resin, such as polyimide, coated on the back surface, that is, the opposite surface of the substrate 118*b* from the fixation nip N. Further, the heater 118 has a heat generating layer 118*c* formed on the insulating layer, of electrically resistive substance, by screen-printing paste of Ag/Pd, $RuO_2$, $Ta_2N$, or the like on the insulating layer to a thickness of roughly 100 μm, and baking the printed layer.

One of the lengthwise ends of the heat generating layer 118*c* is in electrical connection with the electrode 118*e*1 through an electrically conductive portion 118*d*1. As for the other lengthwise end of the heat generating layer 118*c*, it is in electrical connection to the electrode 118*e*2 through the electrically conductive portion 118*d*2. Each of the electrodes 118*e*1 and 118*e*2 is in connection to a pair of electric power supply connectors (unshown), one for one, so that the electrical power is supplied to the heat generating layer 118*b* from an electric power supply control circuit 201 through a pair of the power supply connectors.

The heater 118 is supported, along with the belt guide 101, by the recessed portions 102*a*4 and 102*b*4 of the base portions 102*a*1 and 102*b*1 of the flange 102*a* and 102*b*, respectively. Further, this heater 118 has a fixation belt pressing surface 118*a*. The fixing device B is structured so that this fixation belt pressing surface 118*a* is pressed on the inward surface of the fixation belt 100 to form the fixation nip N. The shape of this fixation belt 118*a* will be described later in detail.

The pressure bearing portions 102*a*3 and 102*b*3 of the flanges 102*a* and 102*b* are under 150 N of pressure applied to the pressure application referential surfaces 117*a* and 117*b* by a pair of coil springs 116*a* and 116*b* in the direction indicated by arrow marks Pa and Pb, respectively. The flanges 102*a* and 102*b* are kept pressed toward the pressure roller 104 by the pressure generated by the pair of coil springs 116*a* and 116*b*. Thus, the fixation belt pressing surface 118*a* of the heater 118 presses on the inward surface of the fixation belt 100, keeping thereby the outward surface of the fixation belt 100 in contact with the peripheral surface of the pressure roller 104.

As the outward surface of the fixation belt 100 is pressed upon the peripheral surface of the pressure roller 104, the rubber layer 106 of the pressure roller 104 is elastically compressed. Consequently, the fixation nip N, which has a preset width, is formed between the outward surface of the fixation belt 100 and the peripheral surface of the pressure roller 104. In this embodiment, the width of the fixation nip N is 6.0 mm.

Like in the case of the first embodiment, the inward surface of the fixation belt 100 is covered with an unshown coated layer of a slippery substance to minimize the friction between the fixation belt 100 and the friction reducing sheet 109. This coated layer is formed of polyimide, and its thickness is no more than 10 μm.

In order to prevent the pressure roller 104 from robbing an excessive amount of heat from the fixation belt 100, the pressure roller 104 is desired to be low in thermal capacity and thermal conductivity. The pressure roller 104 is 20 mm in external diameter. It is made up of a metallic core 105, an elastic layer 106 (silicone rubber layer), and a parting layer 107. The metallic core is formed of SUS. The elastic layer 106 is formed on the peripheral surface of the metallic core 105, and is 3.5 mm in thickness. The parting layer 107 is formed, as the outermost layer, on the outward surface of the elastic layer 106. It is formed of PFA, and is 65 μm in thickness.

(1-2) Driving and Temperature Control of Fixing Device B

The control section C rotationally drives a motor (FIG. 8) M as a driving force source, in response to a print command. The rotation of the output shaft of the motor M is transmitted to a driving gear (unshown) attached to one of the lengthwise ends of the metallic core 105, through a gear train (unshown). Thus, the pressure roller 104 rotates at a preset peripheral velocity in the direction indicated by an arrow mark. In this embodiment, the pressure roller 104 is rotated at a peripheral velocity of 200 mm/sec.

The rotation of this pressure roller 104 is transferred, as belt driving force, to the fixation belt 100 by the friction between the peripheral surface of the pressure roller 104 and the outward surface of the fixation belt 100, in the fixation nip N. Thus, the fixation belt 100 is rotated by the rotation of the pressure roller 104, remaining in contact with the friction reducing sheet 109 by its inward surface.

Further, the control section C drives a triac 201 in response to the print command. As the triac 201 is driven, electric power is supplied to the heat generating layer 118*c* from a commercial electric power source (unshown). As the heat generating layer 108*c* receives electric power, it generates heat. Thus, the heater 118 quickly increases in temperature, and heats the fixation belt 100 from the inward side of the fixation belt loop.

The temperature of the fixation belt 100 is detected by a temperature detecting member S, such as a thermistor, which is placed in the adjacencies of, or in contact with, the outward surface of the fixation belt 100. Then, the signals outputted by the temperature detecting member S are taken in by the control section C. Then, the control section C decides the duty ratio for the voltage to be applied to the heat generating layer 118*c*, and controls the triac 201 to keep the temperature of the heater 118 at a preset level (fixation temperature; target temperature).

While the motor M is rotationally driven, and the heater 118 is being supplied with electric power, a sheet P of recording medium, on which an unfixed toner image is present, is introduced into the fixation nip N, in such an attitude that the image bearing surface of the sheet P faces the fixation belt 100. Then, the sheet P is conveyed through the fixation nip N, remaining sandwiched between the outward surface of the fixation belt 100 and the peripheral surface of the pressure roller 104. While the sheet P is conveyed through the fixation nip N, the unfixed toner image on the sheet P is heated by the heat of the fixation belt 100, and subjected to the internal pressure of the fixation nip N. Thus, the unfixed toner image on the sheet P becomes fixed to the sheet P. Then, the sheet P is conveyed out of the fixation nip N. Then, the sheet P is discharged from the fixing device B in such a manner that the toner image bearing surface of the sheet P separates from the outward surface of the fixation belt 100.

(2) Shape of Fixation Belt Pressing Surface 118*a* of Heater 118

Figure 11:
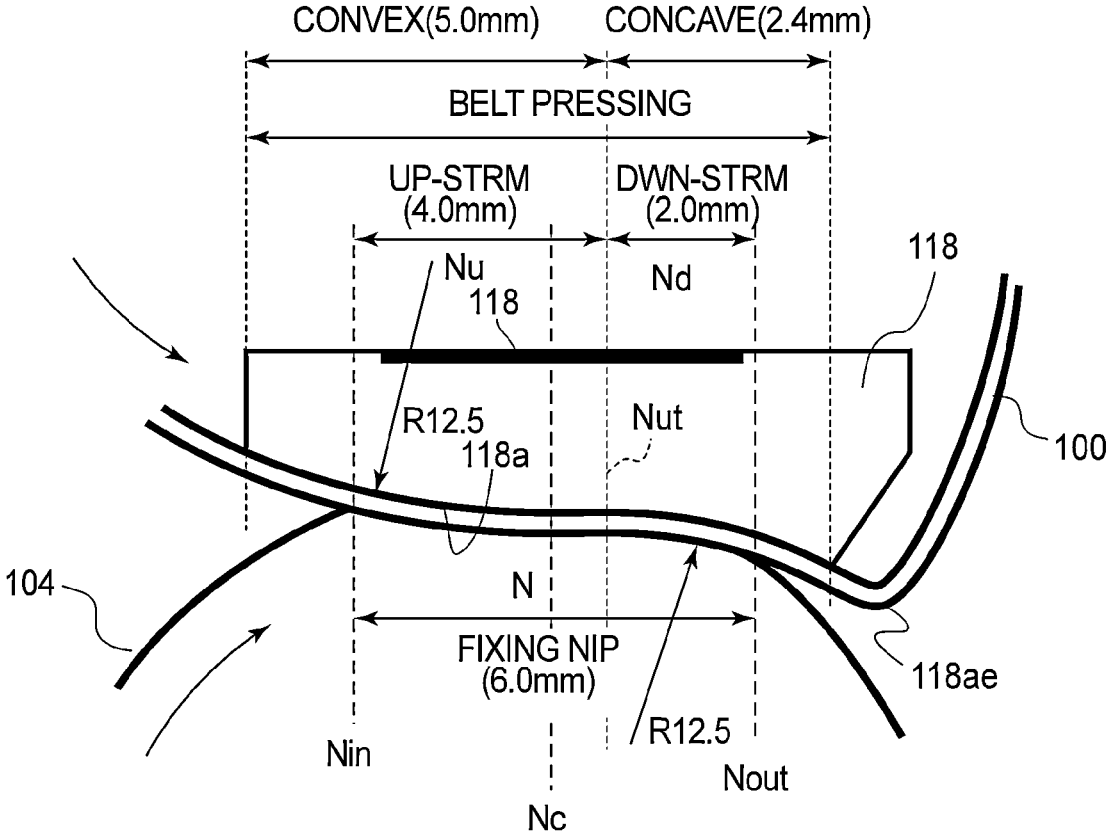
FIG. 11 is a schematic cross-sectional view of the fixation nip, and its adjacencies, of the fixing device in the second embodiment, and shows the general structure of the fixation nip and its adjacencies.

FIG. 11 is a schematic cross-sectional view of the fixation nip N, and its adjacencies, of the fixing device B in this embodiment, and shows the general structure of the fixation nip N and its adjacencies. In order to make it easier to recognize the shape of the fixation belt pressing surface 118*a* of the heater 118, the belt guide 101 and friction reducing sheet 109 are not illustrated in FIG. 11.

Referring to FIG. 11, the nip forming surface 118*a* is the same in basic shape as the counterpart in the first embodiment. That is, in terms of the cross-sectional shape of the fixation belt pressing surface 118*a* of the heater 118, the heater 118 is shaped so that the portion of the fixation belt pressing surface 118*a* of the heater 118, which is in the upstream portion of the fixation nip N bulges in circular curvature toward the pressure roller 104, whereas the portion of the fixation belt pressing surface 118*a*, which is in downstream portion of the fixation nip N, concaves in curvature toward the heat generating layer 118*c*.

Concretely, referring to FIG. 11, the portion of the fixation belt pressing surface 118*a*, which bulges in circular curvature is 5.0 mm in width, and the portion of the fixation belt pressing surface 118*a*, which concaves in curvature, is 2.4 mm in width. Therefore, of the portion of the fixation belt pressing surface 118*a* (fixation nip forming surface) in the fixation nip N which is 6.0 mm in width, the upstream portion which bulges in circular curvature is 4.0 mm in width, and the rest, that is, the downstream portion, which concaves in curvature, is 2.0 mm in width.

That is, in terms of the cross-section shape of the portion of the heater 118 in the fixation nip N, the fixation belt pressing surface 118*a* of the heater 118, which is in the upstream area Nu relative to the center Nc of the fixation nip N in terms of the recording medium conveyance direction, bulges in circular curvature toward the pressure roller 104, whereas the fixation belt pressing surface 118*a* of the heater 118, which is in the downstream area Nd, which is the area between the downstream edge Nut of the upstream area Nu and the downstream edge of the fixation nip N, in terms of the rotational direction of the fixation belt 100, concaves in curvature toward the heat generating layer 118*c*. In FIG. 11, a referential code 118*ae* stands for the most downstream edge of the area of contact between the fixation belt pressing surface 118*a* and fixation belt 100 in terms of the rotational direction of the fixation belt 100.

In the case of the fixing device B in this embodiment, the external diameter of the fixation belt 100 is 25 mm (R12.5). Therefore, the circular curvature in which the fixation belt pressing surface 118*a* bulges in the upstream area Nu in the fixation nip N is made to be R12.5. Here, the relationship between the radius R1 of the circular curvature in which the fixation belt pressing surface 118*a* bulges and the radius R2 of the fixation belt 100 is: R1=R2. Further, the curvature in which the fixation belt pressing surface 118*a* concaves in the downstream area Nd was set also to R12.5 to ensure that a sheet of recording paper satisfactorily separates from the outward surface of the fixation belt 100 as in the first embodiment.

Figure 12:
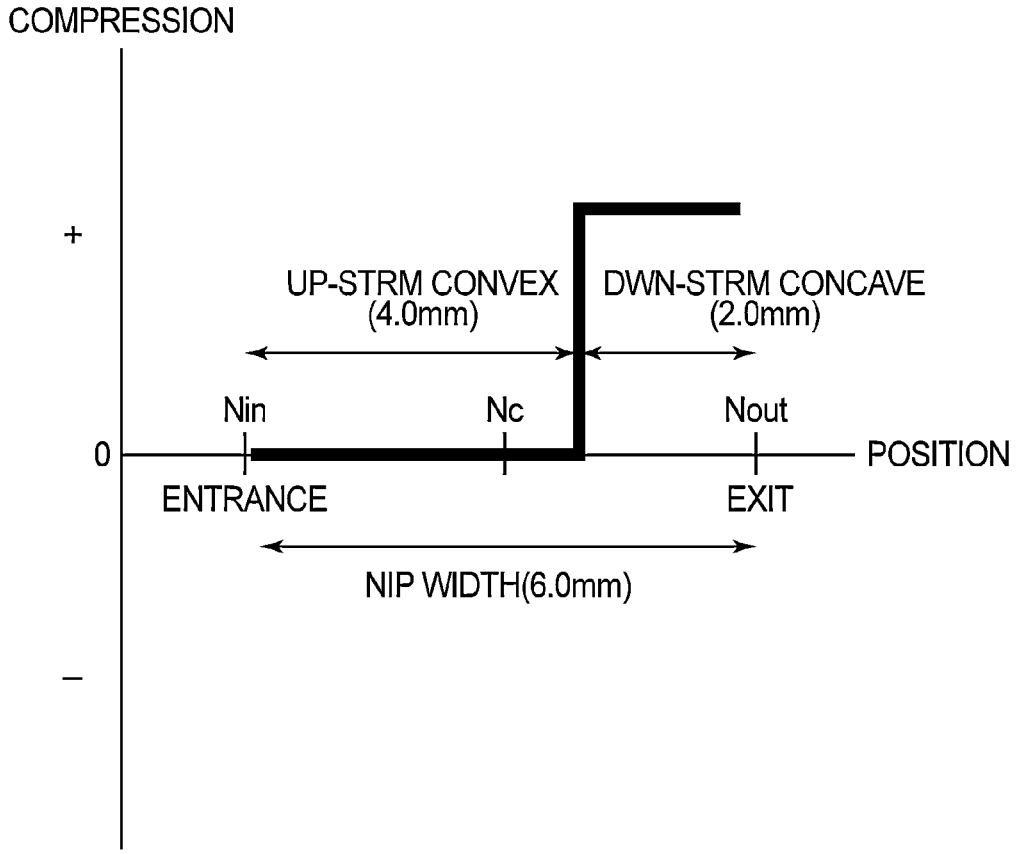
FIG. 12 is a schematic drawing for showing the amount of compression of the outward surface layer of the fixation belt of the fixing device in the second embodiment, in the fixation nip.

Shown in FIG. 12 is the change in the amount of compression of the parting layer 114, or the outward surface layer of the fixation belt 100, which occurs in the fixation nip N. Because the fixing device B in this embodiment is structured as described above, the amount of the compression of the parting layer 114, which occurs in the upstream area Nu of the fixation nip N relative to the center Nc of the fixation nip N is zero. Therefore, the occurrence of the image defect is significantly suppressed.

Embodiment 3

Next, another embodiment of the present invention is described. In the case of the fixing device B in the first embodiment, the circular curvature in which the fixation belt pressing surface 108*a* of the belt backing member 108 is made to bulge toward the pressure roller 104 in the upstream area Nu of the fixation nip N is the same as the curvature of the fixation belt 100. However, the former may be different from the latter. In this embodiment, therefore, the former is made different from the latter. Otherwise, the fixing device B in this embodiment is the same in structure as the fixation device B in the first embodiment.

Figure 13:
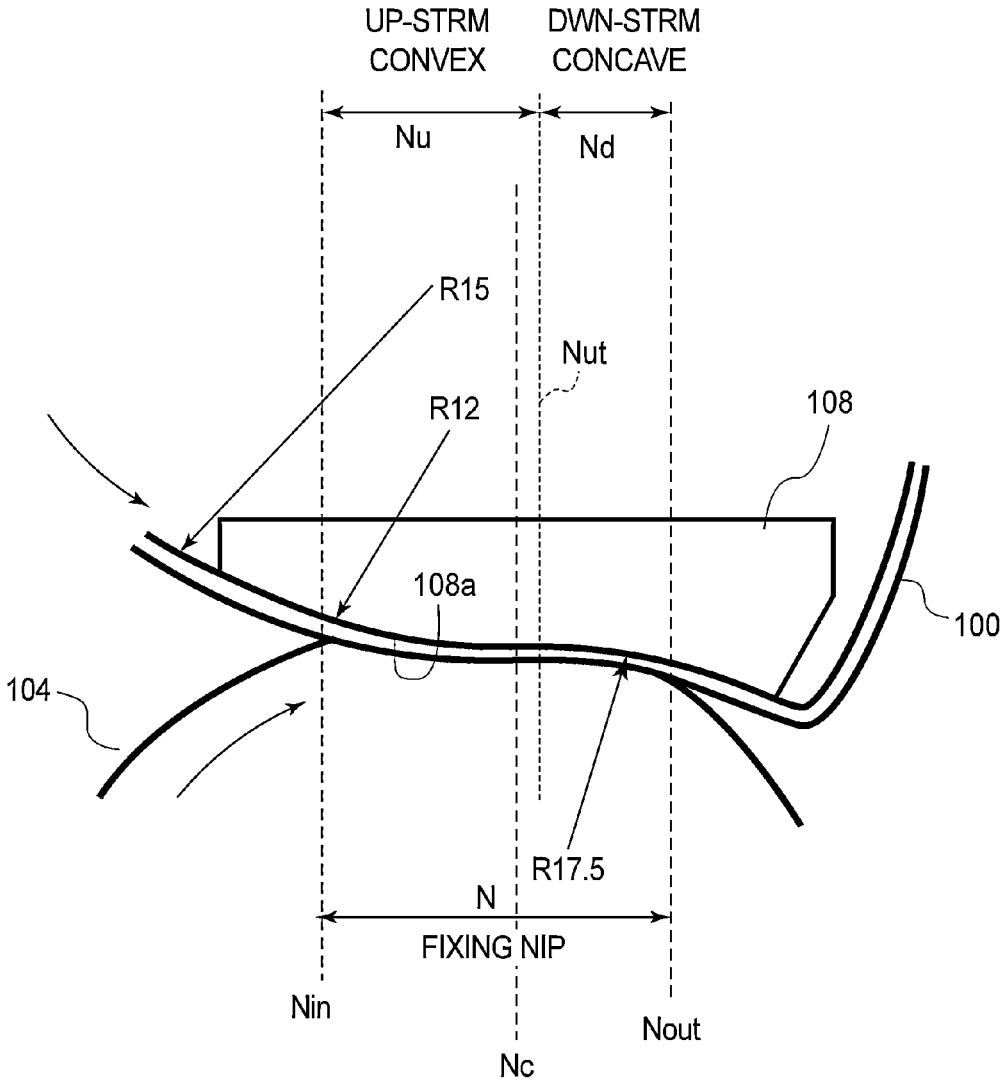
FIG. 13 is a schematic sectional view of the fixation nip, and its adjacencies, of the fixing device in the third embodiment, and shows the general structure of the fixation nip and its adjacencies.

FIG. 13 is a schematic cross-sectional view of the fixation nip N, and its adjacencies, of the fixing device B in this embodiment. It shows the general structure of the fixation nip N and its adjacencies.

Referring to FIG. 13, in the case of the fixing device B in this embodiment, the radius of the fixation belt 100 is R15, and the circular curvature in which the fixation belt pressing surface 108*a* of the belt backing member 108 is made to bulge in the fixation nip N toward the pressure roller 104 is R12 in radius, whereas the circular curvature in which the fixation belt pressing surface 108*a* is made to concave in the downstream area Nd of the fixation nip is R17.5 which is the same as in the first embodiment.

Figure 14:
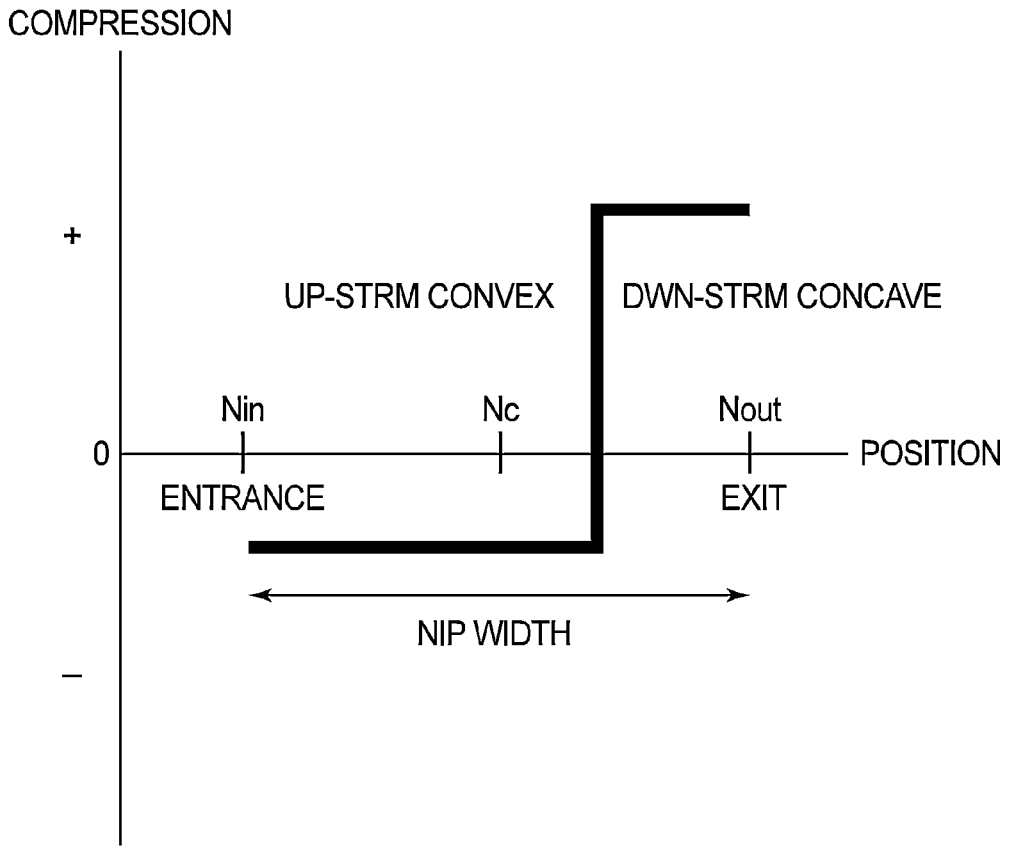
FIG. 14 is a schematic drawing for showing the amount of compression of the outward surface layer of the fixation belt of the fixing device in the third embodiment, in the fixation nip.

Shown in FIG. 14 is the changes in the amount of compression of the outward surface layer of the fixation belt 100, which occur in the fixation nip N of the fixing device B in this embodiment.

In the case of the fixing device B in this embodiment, the circular curvature in which the fixation belt pressing surface 108*a* bulges in the upstream area Nu of the fixation nip N is R12 in radius, which is smaller than the radius R15 of the fixation belt 100. Thus, the relationship between the radiuses R1 and R2 is: R1<R2. Based on Equation (1), therefore, the amount by which the parting layer 114, which is the outward surface layer of the fixation belt 100, is compressed is negative. That is, the parting layer 114 is extended in the fixation nip N.

Therefore, the fixing device B in this embodiment has the same effect as the effect which the fixing device B in the first embodiment has. Further, making the circular curvature in which the fixation belt pressing surface 108*a* of the fixing device B in the second embodiment bulges in the upstream area Nu of the fixation nip N smaller in radius than the fixation belt 100 has the same effect.

[Embodiment 4]

Figure 15:
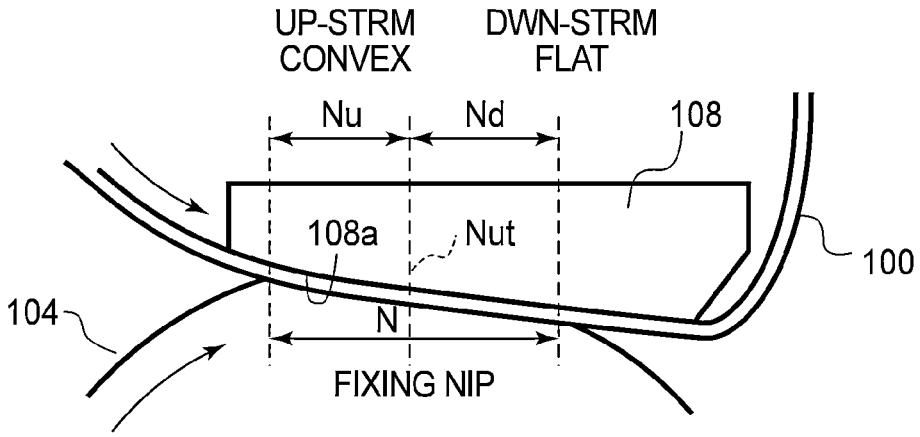
FIG. 15 is a schematic cross-sectional view of the fixation nip, and its adjacencies, of the fixing device in the fourth embodiment, and shows the general structure of the fixation nip and its adjacencies.
Figure 15:
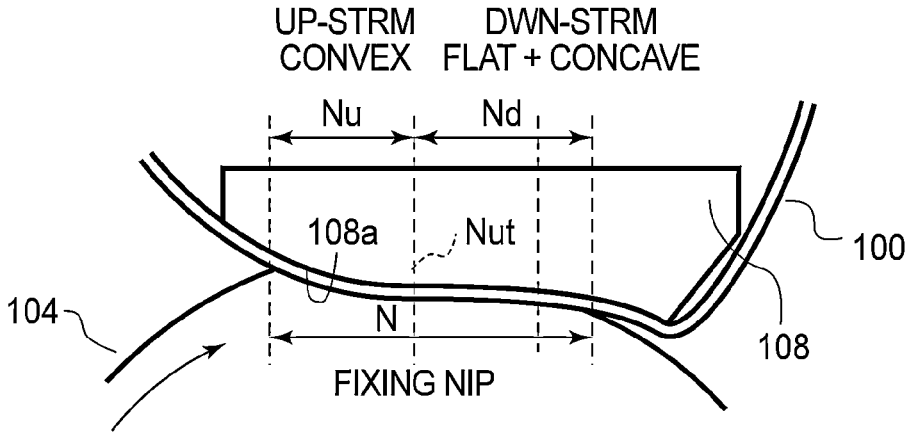

Next, another embodiment of the present invention is described. FIG. 15 is a schematic cross-sectional view of the fixation nip N, and its adjacencies, of the fixing device B in this embodiment. It shows the general structure of the fixation nip N and its adjacencies. FIG. 15(*a*) represents a case in which the portion of the fixation belt pressing surface 108*a*, which is in the downstream area Nd of the fixation nip N, is flat, and FIG. 15(*b*) represents a case in which the portion of the fixation belt pressing surface 108*a*, which is in the downstream area Nd of the fixation nip N, is a combination of a flat portion and a concave portion.

As is evident from the description of the first embodiment, all that is necessary to suppress the occurrence of the above described defective image is to make at least the portion of the fixation belt pressing surface 108*a* of the belt backing member 108, which is the upstream area Nu of the fixation nip N relative to the center Nc of the fixation nip N in terms of the rotational direction f the fixation belt 100, bulge in circular curvature. As for the shape of the portion of the fixation belt pressing surface 108*a*, which is in the downstream area Nd of the fixation nip N, it does not need to be made to concave in circular curvature as it is in the first and second embodiments, as long as it can ensure that a sheet of recording paper separates from the outward surface of the fixation belt 100. Therefore, the portion of the fixation belt pressing surface 108*a*, which is in the downstream area Nd of the fixation nip N, may be flat as shown in FIG. 15(*a*), or a combination of a portion which is flat, and a portion which bulges in circular curvature as shown in FIG. 15(*b*).

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims priority from Japanese Patent Application No. 003235/2013 filed Jan. 11, 2013 which is hereby incorporated by reference.

What is claimed is:

1. A fixing apparatus comprising:

a cylindrical belt;

a back-up member contacting an inner surface of said belt; and a roller contacting an outer surface of said belt, said roller being provided with an elastic layer, said roller being cooperative with said back-up member to sandwich said belt and form a fixing nip between said belt and said roller;

wherein a recording material carrying an unfixed toner image is nipped and fed through the fixing nip, during which the unfixed toner image on the recording material is heated and fixed thereon by the fixing nip, wherein said back-up member includes a portion contactable with the inner surface of said belt, the portion having such a configuration that said belt forms a first curved surface which is substantially convex toward said roller in an upstream region in said fixing nip with respect to a moving direction of said belt and that said belt forms a second curved surface which is substantially convex toward said back-up member in a downstream region in said fixing nip with respect to the moving direction, and wherein a region of the first curved surface extends from a center portion of said fixing nip with respect to the moving direction to a downstream side of said fixing nip.

2. An apparatus according to claim 1, wherein a rotation axis of said belt is offset toward a downstream side relative to a rotation axis of said roller.

3. An apparatus according to claim 1, wherein the first curved surface has a radius of curvature which is not more than a radius of said belt.

4. An apparatus according to claim 1, wherein said belt is provided with a heat generation layer.

5. An apparatus according to claim 1, wherein said back-up member is provided with a heater.

6. An apparatus according to claim 1, wherein said belt includes a rubber layer and a parting layer.

7. A fixing apparatus comprising:

a cylindrical belt;

a back-up member contacting an inner surface of said belt; and a roller contacting an outer surface of said belt, said roller being provided with an elastic layer, said roller being cooperative with said back-up member to sandwich said belt and form a fixing nip between said belt and said roller;

wherein a recording material carrying an unfixed toner image is nipped and fed through the fixing nip, during which the unfixed toner image on the recording material is heated and fixed thereon by the fixing nip, wherein a surface region of said back-up member which contacts the inner surface of said belt within said fixing nip has a first curved surface substantially convex toward said roller and a second curved surface substantially convex toward said back-up member, in the order named with respect to a moving direction of said belt, wherein a region of the first curved surface extends from a center portion of said fixing nip with respect to the moving direction to a downstream side of said fixing nip.

8. An apparatus according to claim 7, wherein a rotation axis of said belt is offset toward a downstream side relative to a rotation axis of said roller.

9. An apparatus according to claim 7, wherein the first curved surface has a radius of curvature which is not more than a radius of said belt.

10. An apparatus according to claim 7, wherein said belt is provided with a heat generation layer.

11. An apparatus according to claim 7, wherein said back-up member is provided with a heater.

12. An apparatus according to claim 7, wherein said belt includes a rubber layer and a parting layer.

* * * * *